US009484674B2

(12) United States Patent
Cartier, Jr. et al.

(10) Patent No.: US 9,484,674 B2
(45) Date of Patent: Nov. 1, 2016

(54) DIFFERENTIAL ELECTRICAL CONNECTOR WITH IMPROVED SKEW CONTROL

(71) Applicants: Marc B. Cartier, Jr., Dover, NH (US); Mark W. Gailus, Concord, MA (US); Vysakh Sivarajan, Nashua, NH (US)

(72) Inventors: Marc B. Cartier, Jr., Dover, NH (US); Mark W. Gailus, Concord, MA (US); Vysakh Sivarajan, Nashua, NH (US)

(73) Assignee: Amphenol Corporation, Wallingford Center, CT (US)

( * ) Notice: Subject to any disclaimer, the term of this patent is extended or adjusted under 35 U.S.C. 154(b) by 88 days.

(21) Appl. No.: 14/209,079

(22) Filed: Mar. 13, 2014

(65) Prior Publication Data

US 2014/0273627 A1 Sep. 18, 2014

Related U.S. Application Data

(60) Provisional application No. 61/784,452, filed on Mar. 14, 2013.

(51) Int. Cl.
*H01R 13/648* (2006.01)
*H01R 13/658* (2011.01)
(Continued)

(52) U.S. Cl.
CPC ..... *H01R 13/658* (2013.01); *H01R 13/6476* (2013.01); *H01R 43/16* (2013.01); *H01R 43/24* (2013.01); *H01R 12/724* (2013.01); *H01R 13/514* (2013.01)

(58) Field of Classification Search
CPC ..... H01R 23/688; H01R 13/6587; H01R 23/668; H01R 13/6594
USPC ..... 439/607.07, 607.11
See application file for complete search history.

(56) References Cited

U.S. PATENT DOCUMENTS 2,996,710 A 8/1961 Pratt
3,002,162 A 9/1961 Garstang
(Continued)

FOREIGN PATENT DOCUMENTS

EP 1 779 472 A1 5/2007
EP 2 169 770 A2 3/2010
(Continued)

OTHER PUBLICATIONS

Extended European Search Report for EP 11166820.8 mailed Jan. 24, 2012.
(Continued)

*Primary Examiner* — Abdullah Riyami
*Assistant Examiner* — Thang Nguyen
(74) *Attorney, Agent, or Firm* — Wolf, Greenfield & Sacks, P.C.

(57) ABSTRACT

An improved electrical connector is provided by compensating for skew in signal conductors of a differential pair while ensuring a uniform impedance along the differential pair. Skew is equalized by regions of lower dielectric constant preferentially positioned adjacent the longer conductor of each pair. Impedance along the length of the signal conductor is equalized by a compensation portion in the first conductor that offsets for a change in impedance associated with the change in dielectric constant adjacent the longer conductor. The compensation portion may be a widening in the first conductive element relative to a nominal width of the conductive element. The skew compensation portion may be along a longer edge of the longer conductor and the impedance compensation portion may be along the shorter edge of the longer conductor.

29 Claims, 12 Drawing Sheets

(51) Int. Cl.

| | |
|---|---|
| ***H01R 13/6476*** | (2011.01) |
| ***H01R 43/16*** | (2006.01) |
| ***H01R 43/24*** | (2006.01) |
| *H01R 12/72* | (2011.01) |
| *H01R 13/514* | (2006.01) |

(56) References Cited

U.S. PATENT DOCUMENTS

| | | | | |
|---|---|---|---|---|
| 3,134,950 | A | 5/1964 | Cook | |
| 3,322,885 | A | 5/1967 | May et al. | |
| 3,786,372 | A | 1/1974 | Epis et al. | |
| 3,825,874 | A | 7/1974 | Peverill | |
| 3,863,181 | A | 1/1975 | Glance et al. | |
| 4,155,613 | A | 5/1979 | Brandeau | |
| 4,195,272 | A | 3/1980 | Boutros | |
| 4,276,523 | A | 6/1981 | Boutros et al. | |
| 4,371,742 | A | 2/1983 | Manly | |
| 4,408,255 | A | 10/1983 | Adkins | |
| 4,447,105 | A | 5/1984 | Ruehl | |
| 4,471,015 | A | 9/1984 | Ebneth et al. | |
| 4,484,159 | A | 11/1984 | Whitley | |
| 4,490,283 | A | 12/1984 | Kleiner | |
| 4,518,651 | A | 5/1985 | Wolfe, Jr. | |
| 4,519,664 | A | 5/1985 | Tillotson | |
| 4,519,665 | A | 5/1985 | Althouse et al. | |
| 4,636,752 | A | 1/1987 | Saito | |
| 4,682,129 | A | 7/1987 | Bakermans et al. | |
| 4,751,479 | A | 6/1988 | Parr | |
| 4,761,147 | A | 8/1988 | Gauthier | |
| 4,846,724 | A | 7/1989 | Sasaki et al. | |
| 4,878,155 | A | 10/1989 | Conley | |
| 4,948,922 | A | 8/1990 | Varadan et al. | |
| 4,970,354 | A | 11/1990 | Iwasa et al. | |
| 4,992,060 | A | 2/1991 | Meyer | |
| 5,000,700 | A | 3/1991 | Masubuchi et al. | |
| 5,141,454 | A | 8/1992 | Garrett et al. | |
| 5,150,086 | A | 9/1992 | Ito | |
| 5,168,252 | A | 12/1992 | Naito | |
| 5,168,432 | A | 12/1992 | Murphy et al. | |
| 5,266,055 | A | 11/1993 | Naito et al. | |
| 5,280,257 | A | 1/1994 | Cravens et al. | |
| 5,287,076 | A | 2/1994 | Johnescu et al. | |
| 5,340,334 | A | 8/1994 | Nguyen | |
| 5,346,410 | A | 9/1994 | Moore, Jr. | |
| 5,456,619 | A | 10/1995 | Belopolsky et al. | |
| 5,461,392 | A | 10/1995 | Mott et al. | |
| 5,499,935 | A | 3/1996 | Powell | |
| 5,551,893 | A | 9/1996 | Johnson | |
| 5,562,497 | A | 10/1996 | Yagi et al. | |
| 5,597,328 | A | 1/1997 | Mouissie | |
| 5,651,702 | A | 7/1997 | Hanning et al. | |
| 5,669,789 | A | 9/1997 | Law | |
| 5,796,323 | A | 8/1998 | Uchikoba et al. | |
| 5,831,491 | A | 11/1998 | Buer et al. | |
| 5,924,899 | A | 7/1999 | Paagman | |
| 5,981,869 | A | 11/1999 | Kroger | |
| 5,982,253 | A | 11/1999 | Perrin et al. | |
| 6,019,616 | A | 2/2000 | Yagi et al. | |
| 6,152,747 | A | 11/2000 | McNamara | |
| 6,168,469 | B1 | 1/2001 | Lu | |
| 6,174,203 | B1 | 1/2001 | Asao | |
| 6,174,944 | B1 | 1/2001 | Chiba et al. | |
| 6,217,372 | B1 | 4/2001 | Reed | |
| 6,293,827 | B1 | 9/2001 | Stokoe | |
| 6,299,483 | B1 | 10/2001 | Cohen et al. | |
| 6,347,962 | B1 | 2/2002 | Kline | |
| 6,350,134 | B1 | 2/2002 | Fogg et al. | |
| 6,364,711 | B1 | 4/2002 | Berg et al. | |
| 6,375,510 | B2 | 4/2002 | Asao | |
| 6,379,188 | B1 | 4/2002 | Cohen et al. | |
| 6,398,588 | B1 | 6/2002 | Bickford | |
| 6,409,543 | B1 | 6/2002 | Astbury, Jr. et al. | |
| 6,482,017 | B1 | 11/2002 | Van Doorn | |
| 6,503,103 | B1 | 1/2003 | Cohen et al. | |
| 6,506,076 | B2 | 1/2003 | Cohen et al. | |
| 6,517,360 | B1 | 2/2003 | Cohen | |
| 6,530,790 | B1 | 3/2003 | McNamara et al. | |
| 6,537,087 | B2 | 3/2003 | McNamara et al. | |
| 6,554,647 | B1 | 4/2003 | Cohen et al. | |
| 6,565,387 | B2 | 5/2003 | Cohen | |
| 6,579,116 | B2 | 6/2003 | Brennan et al. | |
| 6,595,802 | B1 | 7/2003 | Watanabe et al. | |
| 6,602,095 | B2 | 8/2003 | Astbury, Jr. et al. | |
| 6,616,864 | B1 | 9/2003 | Jiang et al. | |
| 6,652,318 | B1 | 11/2003 | Winings et al. | |
| 6,655,966 | B2 | 12/2003 | Rothermel et al. | |
| 6,709,294 | B1 | 3/2004 | Cohen et al. | |
| 6,713,672 | B1 | 3/2004 | Stickney | |
| 6,743,057 | B2 | 6/2004 | Davis et al. | |
| 6,776,659 | B1 | 8/2004 | Stokoe et al. | |
| 6,786,771 | B2 | 9/2004 | Gailus | |
| 6,814,619 | B1 | 11/2004 | Stokoe et al. | |
| 6,872,085 | B1 | 3/2005 | Cohen et al. | |
| 6,979,226 | B2 | 12/2005 | Otsu et al. | |
| 7,044,794 | B2 | 5/2006 | Consoli et al. | |
| 7,057,570 | B2 | 6/2006 | Irion, II et al. | |
| 7,074,086 | B2 | 7/2006 | Cohen et al. | |
| 7,094,102 | B2 | 8/2006 | Cohen et al. | |
| 7,108,556 | B2 | 9/2006 | Cohen et al. | |
| 7,163,421 | B1 | 1/2007 | Cohen et al. | |
| 7,285,018 | B2 | 10/2007 | Kenny et al. | |
| 7,335,063 | B2 | 2/2008 | Cohen et al. | |
| 7,371,117 | B2 | 5/2008 | Gailus | |
| 7,494,383 | B2 | 2/2009 | Cohen et al. | |
| 7,540,781 | B2 | 6/2009 | Kenny et al. | |
| 7,581,990 | B2 | 9/2009 | Kirk et al. | |
| 7,588,464 | B2 | 9/2009 | Kim | |
| 7,722,401 | B2 | 5/2010 | Kirk et al. | |
| 7,731,537 | B2 | 6/2010 | Amleshi et al. | |
| 7,753,731 | B2 | 7/2010 | Cohen et al. | |
| 7,771,233 | B2 | 8/2010 | Gailus | |
| 7,794,240 | B2 | 9/2010 | Cohen et al. | |
| 7,867,031 | B2 * | 1/2011 | Amleshi ..... | H01R 13/6471 439/607.08 |
| 7,874,873 | B2 | 1/2011 | Do et al. | |
| 7,887,371 | B2 | 2/2011 | Kenny et al. | |
| 7,906,730 | B2 | 3/2011 | Atkinson et al. | |
| 7,914,304 | B2 | 3/2011 | Cartier et al. | |
| 8,083,553 | B2 | 12/2011 | Manter et al. | |
| 8,182,289 | B2 | 5/2012 | Stokoe et al. | |
| 8,215,968 | B2 | 7/2012 | Cartier et al. | |
| 8,272,877 | B2 | 9/2012 | Stokoe et al. | |
| 8,371,875 | B2 | 2/2013 | Gailus | |
| 8,382,524 | B2 | 2/2013 | Khilchenko et al. | |
| 8,657,627 | B2 | 2/2014 | McNamara et al. | |
| 8,715,003 | B2 | 5/2014 | Buck et al. | |
| 8,771,016 | B2 | 7/2014 | Atkinson et al. | |
| 8,864,521 | B2 | 10/2014 | Atkinson et al. | |
| 8,926,377 | B2 | 1/2015 | Kirk et al. | |
| 8,944,831 | B2 | 2/2015 | Stoner et al. | |
| 8,998,642 | B2 | 4/2015 | Manter et al. | |
| 9,004,942 | B2 | 4/2015 | Paniauqa | |
| 9,022,806 | B2 | 5/2015 | Cartier, Jr. et al. | |
| 9,028,281 | B2 | 5/2015 | Kirk et al. | |
| 9,124,009 | B2 | 9/2015 | Atkinson et al. | |
| 9,219,335 | B2 * | 12/2015 | Atkinson ..... | H01R 13/6471 |
| 9,225,085 | B2 | 12/2015 | Cartier, Jr. et al. | |
| 2001/0042632 | A1 | 11/2001 | Manov et al. | |
| 2002/0042223 | A1 | 4/2002 | Belopolsky et al. | |
| 2002/0089464 | A1 | 7/2002 | Joshi | |
| 2002/0098738 | A1 | 7/2002 | Astbury et al. | |
| 2002/0111068 | A1 | 8/2002 | Cohen et al. | |
| 2002/0111069 | A1 | 8/2002 | Astbury et al. | |
| 2003/0092291 | A1 | 5/2003 | Lemke et al. | |
| 2004/0020674 | A1 | 2/2004 | McFadden et al. | |
| 2004/0115968 | A1 | 6/2004 | Cohen | |
| 2004/0121652 | A1 | 6/2004 | Gailus | |
| 2004/0196112 | A1 | 10/2004 | Welbon et al. | |
| 2004/0259419 | A1 | 12/2004 | Payne et al. | |
| 2005/0070160 | A1 | 3/2005 | Cohen et al. | |
| 2005/0133245 | A1 | 6/2005 | Katsuyama et al. | |
| 2005/0176835 | A1 | 8/2005 | Kobayashi et al. | |
| 2005/0283974 | A1 | 12/2005 | Richard et al. | |
| 2005/0287869 | A1 | 12/2005 | Kenny et al. | |

(56) References Cited

U.S. PATENT DOCUMENTS

| | | | | |
|---|---|---|---|---|
| 2006/0068640 | A1 | 3/2006 | Gailus | |
| 2007/0004282 | A1 | 1/2007 | Cohen et al. | |
| 2007/0021001 | A1 | 1/2007 | Laurx et al. | |
| 2007/0037419 | A1 | 2/2007 | Sparrowhawk | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0218765 | A1 | 9/2007 | Cohen et al. | |
| 2008/0194146 | A1 | 8/2008 | Gailus | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2008/0248660 | A1 | 10/2008 | Kirk et al. | |
| 2009/0011641 | A1 | 1/2009 | Cohen et al. | |
| 2009/0011643 | A1 | 1/2009 | Amleshi et al. | |
| 2009/0011645 | A1 | 1/2009 | Laurx et al. | |
| 2009/0117386 | A1 | 5/2009 | Vacanti et al. | |
| 2009/0239395 | A1 | 9/2009 | Cohen et al. | |
| 2009/0291593 | A1 | 11/2009 | Atkinson et al. | |
| 2010/0081302 | A1 | 4/2010 | Atkinson et al. | |
| 2010/0291803 | A1* | 11/2010 | Kirk | H01R 23/688 439/660 |
| 2010/0294530 | A1 | 11/2010 | Atkinson et al. | |
| 2011/0003509 | A1 | 1/2011 | Gailus | |
| 2011/0067237 | A1* | 3/2011 | Cohen | H01R 12/58 29/857 |
| 2011/0104948 | A1 | 5/2011 | Girard, Jr. et al. | |
| 2011/0212649 | A1* | 9/2011 | Stokoe | H01R 23/688 439/626 |
| 2011/0212650 | A1 | 9/2011 | Amleshi et al. | |
| 2011/0230095 | A1 | 9/2011 | Atkinson et al. | |
| 2011/0230096 | A1 | 9/2011 | Atkinson et al. | |
| 2011/0287663 | A1 | 11/2011 | Gailus et al. | |
| 2012/0094536 | A1 | 4/2012 | Khilchenko et al. | |
| 2012/0156929 | A1 | 6/2012 | Manter et al. | |
| 2012/0202363 | A1 | 8/2012 | McNamara et al. | |
| 2012/0202386 | A1 | 8/2012 | McNamara et al. | |
| 2012/0214344 | A1 | 8/2012 | Cohen et al. | |
| 2013/0012038 | A1 | 1/2013 | Kirk et al. | |
| 2013/0017733 | A1 | 1/2013 | Kirk et al. | |
| 2013/0078870 | A1 | 3/2013 | Milbrand, Jr. | |
| 2013/0109232 | A1 | 5/2013 | Paniaqua | |
| 2013/0196553 | A1 | 8/2013 | Gailus | |
| 2013/0217263 | A1* | 8/2013 | Pan | H01R 13/6474 439/607.07 |
| 2013/0225006 | A1 | 8/2013 | Khilchenko et al. | |
| 2014/0004724 | A1 | 1/2014 | Cartier, Jr. et al. | |
| 2014/0004726 | A1 | 1/2014 | Cartier, Jr. et al. | |
| 2014/0004746 | A1 | 1/2014 | Cartier, Jr. et al. | |
| 2014/0057498 | A1 | 2/2014 | Cohen | |
| 2014/0273557 | A1 | 9/2014 | Cartier, Jr. et al. | |
| 2015/0056856 | A1 | 2/2015 | Atkinson et al. | |
| 2015/0236451 | A1 | 8/2015 | Cartier, Jr. et al. | |
| 2015/0236452 | A1 | 8/2015 | Cartier, Jr. et al. | |
| 2015/0255926 | A1 | 9/2015 | Paniagua | |

FOREIGN PATENT DOCUMENTS

| | | | |
|---|---|---|---|
| GB | 1272347 | A | 4/1972 |
| JP | 07302649 | A | 11/1995 |
| JP | 2003-536205 | A | 12/2003 |
| WO | WO 88/05218 | A1 | 7/1988 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/039188 | A1 | 4/2010 |

OTHER PUBLICATIONS

International Search Report with Written Opinion for International Application No. PCT/US06/25562 dated Oct. 31, 2007.
International Search Report and Written Opinion from PCT Application No. PCT/US2005/034605 dated Jan. 26, 2006.
International Search Report and Written Opinion for International Application No. PCT/US2010/056482 issued Mar. 14, 2011.
International Preliminary Report on Patentability for International Application No. PCT/US2010/056482 issued May 24, 2012.
International Search Report and Written Opinion for PCT/US2011/026139 dated Nov. 22, 2011.
International Preliminary Report on Patentability for PCT/US2011/026139 dated Sep. 7, 2012.
International Search Report and Written Opinion for International Application No. PCT/US2011/034747 dated Jul. 28, 2011.
PCT Search Report and Written Opinion for Application No. PCT/US2012/023689 mailed on Sep. 12, 2012.
International Preliminary Report on Patentability for Application No. PCT/US2012/023689 mailed on Aug. 15, 2013.
International Search Report and Written Opinion for PCT/US2012/060610 dated Mar. 29, 2013.
International Search Report and Written Opinion for International Application No. PCT/US2014/028090 issued Aug. 7, 2014.
[No Author Listed] "Carbon Nanotubes for Electromagnetic Interference Shielding," SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables, Electronic Components and Technology Conference, 1997, pp. 911-917.
Shi et al, "Improving Signal Integrity in Circuit Boards by Incorporating Absorbing Materials," 2001 Proceedings. 51st Electronic Components and Technology Conference, Orlando FL. 2001:1451-56.
U.S. Appl. No. 13/752,534, filed Jan. 29, 2013, Gailus et al.
U.S. Appl. No. 13/775,808, filed Feb. 25, 2013, Khilchenko et al.
U.S. Appl. No. 14/948,171, filed Nov. 20, 2015, Atkinson et al.
U.S. Appl. No. 13/683,295, filed Nov. 21, 2012, Milbrand, Jr.
U.S. Appl. No. 13/973,921, filed Aug. 22, 2013, Cohen.
U.S. Appl. No. 13/930,447, filed Jun. 28, 2013, Cartier, Jr. et al.
U.S. Appl. No. 14/640,114, filed Mar. 6, 2015, Paniagua.
U.S. Appl. No. 14/209,240, filed Mar. 13, 2014, Cartier, Jr. et al.
U.S. Appl. No. 14/603,300, filed Jan. 22, 2015, Cartier, Jr. et al.
U.S. Appl. No. 14/603,294, filed Jan. 22, 2015, Cartier, Jr. et al.
International Search Report and Written Opinion mailed May 13, 2015 for Application No. PCT/US2015/012463.

* cited by examiner

DIFFERENTIAL ELECTRICAL CONNECTOR WITH IMPROVED SKEW CONTROL

RELATED APPLICATION

The present application claims the benefit of U.S. Provisional Application Ser. No. 61/784,452, filed Mar. 14, 2013, which is hereby incorporated by reference herein in its entirety.

BACKGROUND OF INVENTION

This invention relates generally to electrical interconnection systems and more specifically to improved signal integrity in interconnection systems, particularly in high speed electrical connectors.

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, shield members are often placed between or around adjacent signal conductors. The shields prevent signals carried on one conductor from creating "crosstalk" on another conductor. The shield also impacts the impedance of each conductor, which can further contribute to desirable electrical properties.

Other techniques may be used to control the performance of a connector. Transmitting signals differentially can also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

Examples of differential electrical connectors are shown in U.S. Pat. Nos. 6,293,827, 6,503,103, 6,776,659, and 7,163,421, all of which are assigned to the assignee of the present application and are hereby incorporated by reference in their entireties. Differential connectors with skew control are known. U.S. Pat. No. 6,503,103, for example, describes windows in an insulative housing above a longer leg of a differential pair of conductors. The windows increase the propagation velocity of an electrical signal carried by a longer conductor of the pair relative to propagation velocity of a signal carried by the shorter conductor. As a result, these windows reduce the differential propagation delay of a signal along the two legs, or "skew" of the pair.

SUMMARY OF INVENTION

An improved differential electrical connector is provided through improved skew control. The inventors have recognized and appreciated techniques for improving high frequency, differential connectors.

In some aspects, an electrical connector is provided. The electrical connector may comprise a housing and a plurality of conductive elements comprising intermediate portions held within the housing. The plurality of conductive elements may comprise at least one pair comprising a first conductive element and a second conductive element, the first conductive element being longer than the second conductive element. The housing may comprise a first region of a first dielectric constant and a second region of a second dielectric constant. The second dielectric constant may be lower than the first dielectric constant. The second region may be preferentially positioned over the first conductive element. The first conductive element may comprise a widened portion adjacent the second region.

In some embodiments, the second region may compensate for skew and the widened portion may compensate for impedance changes associated with the skew compensation features by providing an impedance adjacent the skew compensation features that is comparable to the nominal impedance of the pair.

In yet another aspect, a method of manufacturing an electrical connector is provided. The method may comprise stamping a lead frame comprising a plurality of conductive elements disposed in pairs, each of the pairs comprising a first, longer, conductive element and a second, shorter conductive element, wherein the longer conductive element comprises a widened portion. The method may also include molding an insulative housing over a portion of the lead frame, leaving recesses preferentially positioned over the first conductive element of each of the pairs, the recesses being located at least in part over regions of the first conductors adjacent the widened portions.

In yet other aspects, an electrical connector may be provided. The electrical connector may comprise a housing and a plurality of conductive elements comprising intermediate portions held within the housing, the plurality of conductive elements comprising at least one pair comprising a first conductive element and a second conductive element, the first conductive element being longer than the second conductive element. The housing may comprise a first region of a first dielectric constant and a second region of a second dielectric constant and a third region of lossy material. The second dielectric constant may be lower than the first dielectric constant. The second region may be positioned with respect to the first conductive element to compensate for skew between the first and second conductive elements. The first conductive element may comprise an impedance compensation portion along an edge of the first conductive element facing the second conductive element adjacent the second region.

The foregoing is a non-limiting summary of the invention, which is defined by the appended claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The inventors have recognized and appreciated that improved performance may be achieved in a differential electrical connector by incorporating skew compensation and compensation for impedance changes associated with skew compensation features into some or all of the differential pairs of a connector. The inventors have recognized and appreciated an approach to simply incorporate the features that provide skew compensation and impedance control into a high speed, high density electrical connector.

The skew compensation may be applied by creating a section of higher signal propagation speed along the longer conductive element of one or more of the differential pairs of the connector. Such skew compensation may be in the form of a region of lower dielectric constant material, such as a window, in an insulative housing above an intermediate portion of the conductive elements. The region may be selectively positioned over the longer conductive element of one or more of the differential pairs to impact signal propagation near a longer edge of the longer conductive element. This selective positioning, for example, may be achieved by offsetting the region with respect to a nominal center line of the conductive element. In some embodiments, the selective positioning may center the region over a space between the longer conductive element and an adjacent ground conductor.

However, features that create the higher signal propagation speed to compensate for skew may alter impedance along the differential pair. To avoid an impedance discontinuity that might create signal reflections, cause mode conversion, increase insertion loss or otherwise contribute to undesired electrical properties of the connector, an impedance compensation section may be associated with the edge of the longer conductive element facing the shorter conductive element of the pair. The impedance compensation section may be adjacent the skew compensation section.

Any suitable impedance compensation section may be formed, including a widening of the longer conductive element. This widening may be adjacent the skew compensation portion such that the effect of the impedance compensation portion averages out with any impact on impedance of the skew compensation section. In some embodiments, the widening of the longer conductor may be created by jogging an edge of the shorter conductor that is opposite the edge adjacent the longer conductor to accommodate for this widening while maintaining a uniform edge-to-edge spacing.

Figure 1:
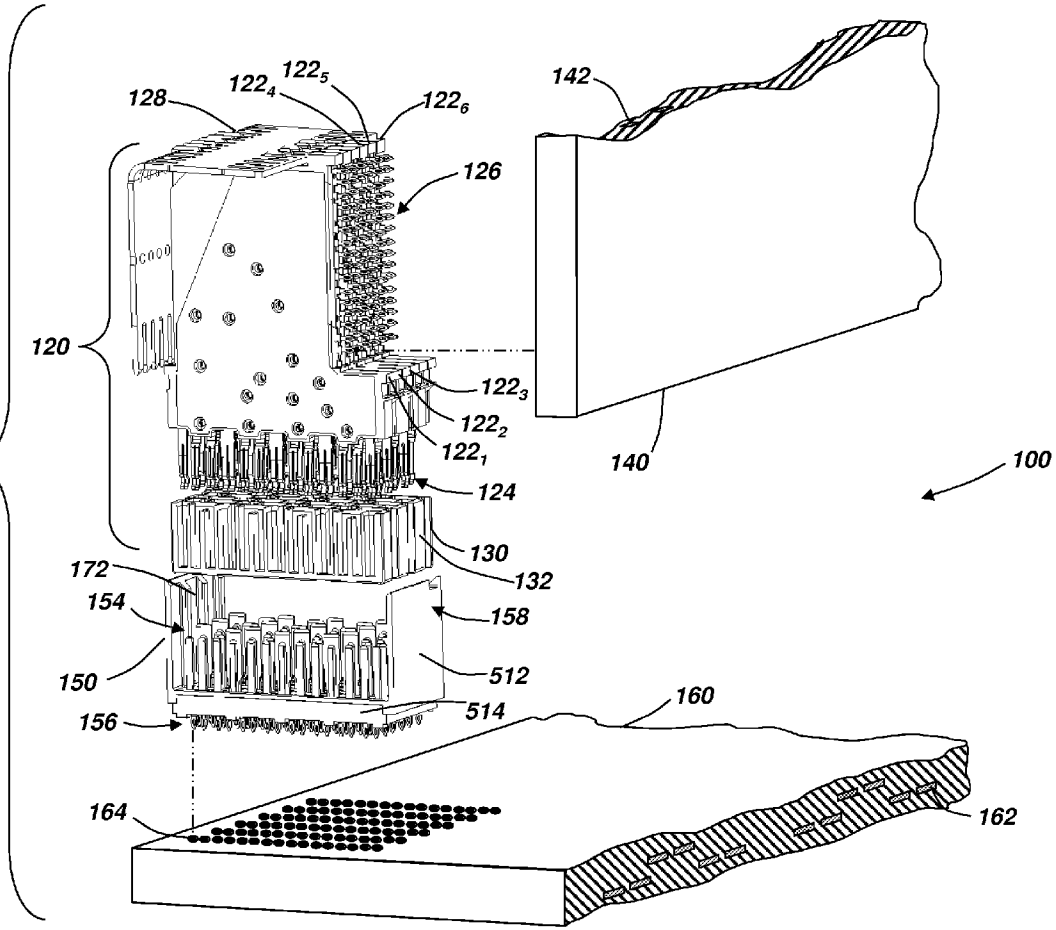
FIG. 1 is a perspective view of an electrical interconnection system according to an embodiment of the present invention.

Such features may be incorporated into any suitable connector. Non-limiting examples of such a connector are described below. Referring to FIG. 1, an electrical interconnection system 100 with two connectors is shown. The electrical interconnection system 100 includes a daughter card connector 120 and a backplane connector 150.

Daughter card connector 120 is designed to mate with backplane connector 150, creating electronically conducting paths between backplane 160 and daughter card 140. Though not expressly shown, interconnection system 100 may interconnect multiple daughter cards having similar daughter card connectors that mate to similar backplane connections on backplane 160. Accordingly, the number and type of subassemblies connected through an interconnection system is not a limitation on the invention.

FIG. 1 shows an interconnection system using a right-angle, backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter connector 120 each contains conductive elements. The conductive elements of daughter card connector 120 are coupled to traces (of which trace 142 is numbered), ground planes or other conductive elements within daughter card 140. The traces carry electrical signals and the ground planes provide reference levels for components on daughter card 140. Ground planes may have voltages that are at earth ground or positive or negative with respect to earth ground, as any voltage level may act as a reference level.

Similarly, conductive elements in backplane connector 150 are coupled to traces (of which trace 162 is numbered), ground planes or other conductive elements within backplane 160. When daughter card connector 120 and backplane connector 150 mate, conductive elements in the two connectors mate to complete electrically conductive paths between the conductive elements within backplane 160 and daughter card 140.

Figure 6C:
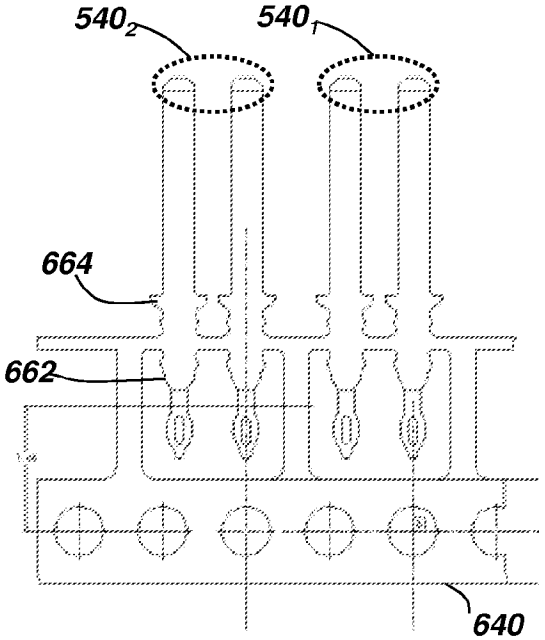
FIGS. 6A-6C are enlarged detail views of conductors used in the manufacture of a backplane connector according to an embodiment of the present invention.
Figure 6B:
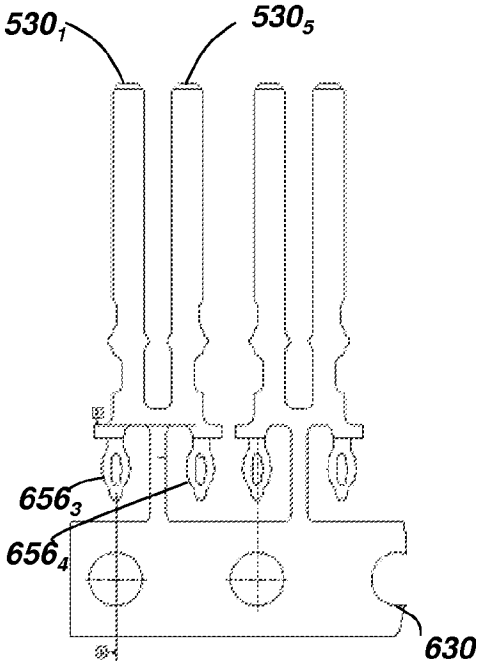
Figure 6A:
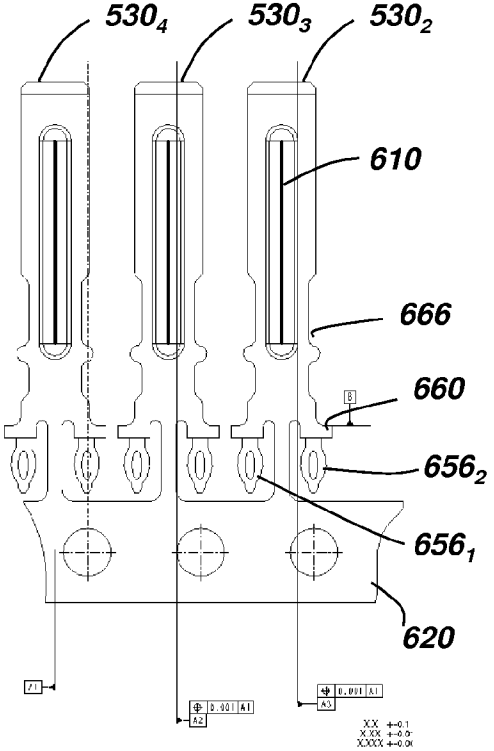

Backplane connector 150 includes a backplane shroud 158 and a plurality conductive elements (see FIGS. 6A-6C).

The conductive elements of backplane connector 150 extend through floor 514 of the backplane shroud 158 with portions both above and below floor 514. Here, the portions of the conductive elements that extend above floor 514 form mating contacts, shown collectively as mating contact portions 154, which are adapted to mate to corresponding conductive elements of daughter card connector 120. In the illustrated embodiment, mating contacts 154 are in the form of blades, although other suitable contact configurations may be employed, as the present invention is not limited in this regard.

Tail portions, shown collectively as contact tails 156, of the conductive elements extend below the shroud floor 514 and are adapted to be attached to a substrate, such as backplane 160. Here, the tail portions are in the form of a press fit, "eye of the needle" compliant sections that fit within via holes, shown collectively as via holes 164, on backplane 160. However, other configurations are also suitable, such as surface mount elements, spring contacts, solderable pins, etc., as the present invention is not limited in this regard.

In the embodiment illustrated, backplane shroud 158 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form backplane shroud 158 to control the electrical or mechanical properties of backplane shroud 150. For example, thermoplastic PPS filled to 30% by volume with glass fiber may be used to form shroud 158.

In the embodiment illustrated, backplane connector 150 is manufactured by molding backplane shroud 158 with openings to receive conductive elements. The conductive elements may be shaped with barbs or other retention features that hold the conductive elements in place when inserted in the opening of backplane shroud 158.

Figure 5A:
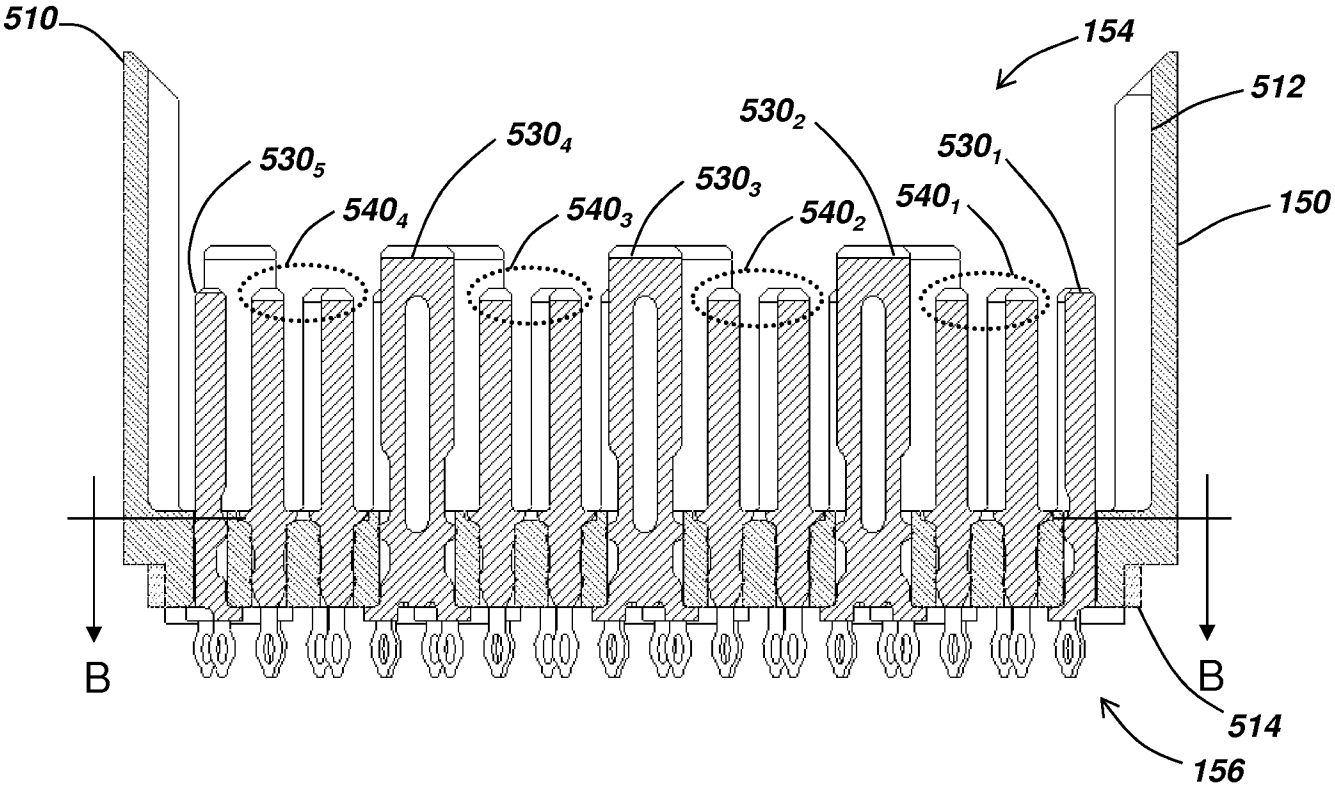
FIG. 5A is a cross-sectional representation of a backplane connector according to an embodiment of the present invention.

As shown in FIG. 1 and FIG. 5A, the backplane shroud 158 further includes side walls 512 that extend along the length of opposing sides of the backplane shroud 158. The side walls 512 include grooves 172, which run vertically along an inner surface of the side walls 512. Grooves 172 serve to guide front housing 130 of daughter card connector 120 via mating projections 132 into the appropriate position in shroud 158.

Daughter card connector 120 includes a plurality of wafers $\mathbf{122}_1 \ldots \mathbf{122}_6$ coupled together, with each of the plurality of wafers $\mathbf{122}_1 \ldots \mathbf{122}_6$ having a housing 260 (see FIGS. 2A-2C) and a column of conductive elements. In the illustrated embodiment, each column has a plurality of signal conductors 420 (see FIG. 4A) and a plurality of ground conductors 430 (see FIG. 4A). The ground conductors may be employed within each wafer $\mathbf{122}_1 \ldots \mathbf{122}_6$ to minimize crosstalk between signal conductors or to otherwise control the electrical properties of the connector.

Wafers $\mathbf{122}_1 \ldots \mathbf{122}_6$ may be formed by molding housing 260 around conductive elements that form signal and ground conductors. As with shroud 158 of backplane connector 150, housing 260 may be formed of any suitable material and may include portions that have conductive filler or are otherwise made lossy.

In the illustrated embodiment, daughter card connector 120 is a right angle connector and has conductive elements that traverse a right angle. As a result, opposing ends of the conductive elements extend from surfaces on perpendicular edges of the wafers $\mathbf{122}_1 \ldots \mathbf{122}_6$.

Each conductive element of wafers $\mathbf{122}_1 \ldots \mathbf{122}_6$ has at least one contact tail, shown collectively as contact tails 126, which can be connected to daughter card 140. Each conductive element in daughter card connector 120 also has a mating contact portion, shown collectively as mating contacts 124, which can be connected to a corresponding conductive element in backplane connector 150. Each conductive element also has an intermediate portion between the mating contact portion and the contact tail, which may be enclosed by or embedded within a wafer housing 260 (see FIG. 2).

The contact tails 126 electrically connect the conductive elements within daughter card and connector 120 to conductive elements in a substrate, such as traces 142 in daughter card 140. In the embodiment illustrated, contact tails 126 are press fit "eye of the needle" contacts that make an electrical connection through via holes in daughter card 140. However, any suitable attachment mechanism may be used instead of or in addition to via holes and press fit contact tails.

In the illustrated embodiment, each of the mating contacts 124 has a dual beam structure configured to mate to a corresponding mating contact 154 of backplane connector 150. The conductive elements acting as signal conductors may be grouped in pairs, separated by ground conductors in a configuration suitable for use as a differential electrical connector. However, embodiments are possible for single-ended use in which the conductive elements are evenly spaced without designated ground conductors separating signal conductors or with a ground conductor between each signal conductor.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on positioning of those elements that provides preferential coupling between the conductive elements that make up the pair. Electrical characteristics of the pair, such as its impedance, that make it suitable for carrying a differential signal may provide an alternative or additional method of identifying a differential pair. As another example, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

For exemplary purposes only, daughter card connector 120 is illustrated with six wafers $\mathbf{122}_1 \ldots \mathbf{122}_6$, with each wafer having a plurality of pairs of signal conductors and adjacent ground conductors. As pictured, each of the wafers $\mathbf{122}_1 \ldots \mathbf{122}_6$ includes one column of conductive elements. However, the present invention is not limited in this regard, as the number of wafers and the number of signal conductors and ground conductors in each wafer may be varied as desired.

As shown, each wafer $\mathbf{122}_1 \ldots \mathbf{122}_6$ is inserted into front housing 130 such that mating contacts 124 are inserted into and held within openings in front housing 130. The openings in front housing 130 are positioned so as to allow mating contacts 154 of the backplane connector 150 to enter the openings in front housing 130 and allow electrical connection with mating contacts 124 when daughter card connector 120 is mated to backplane connector 150.

Daughter card connector 120 may include a support member instead of or in addition to front housing 130 to hold wafers $\mathbf{122}_1 \ldots \mathbf{122}_6$. In the pictured embodiment, stiffener 128 supports the plurality of wafers $\mathbf{122}_1 \ldots \mathbf{122}_6$. Stiffener 128 is, in the embodiment illustrated, a stamped metal member. Though, stiffener 128 may be formed from any suitable material. Stiffener 128 may be stamped with slots, holes, grooves or other features that can engage a wafer.

Each wafer $\mathbf{122}_1 \ldots \mathbf{122}_6$ may include attachment features 242, 244 (see FIG. 2A-2B) that engage stiffener 128 to locate each wafer 122 with respect to another and further to prevent rotation of the wafer 122. Of course, the present invention is not limited in this regard, and no stiffener need be employed. Further, although the stiffener is shown to be L-shaped and attached to an upper and side portion of the plurality of wafers, the present invention is not limited in this respect, as other suitable locations may be employed. The stiffener need not be L-shaped or need to be a unitary member. As an example of possible variations, separate metal members could be attached to upper ad side portions of the wafer or could be attached to just one of the upper or side portions.

Figure 2B:
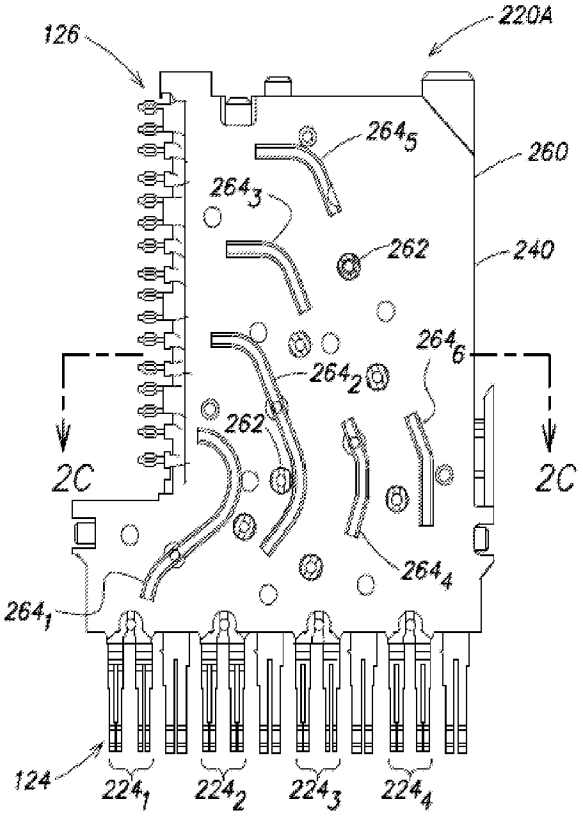
FIGS. 2A and 2B are views of a first and second side of a wafer forming a portion of the electrical connector of FIG. 1.
Figure 2A:
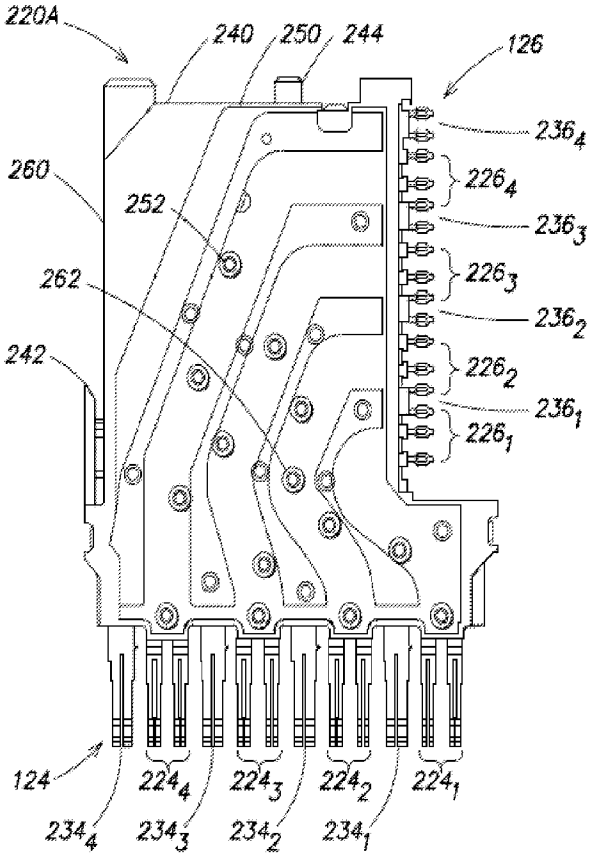

FIGS. 2A-2B illustrate opposing side views of an exemplary wafer 220A. Wafer 220A may be formed in whole or in part by injection molding of material to form housing 260 around a wafer strip assembly such as 410A or 410B (FIG. 4). In the pictured embodiment, wafer 220A is formed with a two shot molding operation, allowing housing 260 to be formed of two types of material having different material properties. Insulative portion 240 is formed in a first shot and lossy portion 250 is formed in a second shot. However, any suitable number and types of material may be used in housing 260. In one embodiment, the housing 260 is formed around a column of conductive elements by injection molding plastic.

Contact tails 126 are grouped into signal conductor tails $\mathbf{226}_1 \ldots \mathbf{226}_4$ and ground conductor tails $\mathbf{236}_1 \ldots \mathbf{236}_4$. Similarly, mating contacts 124 corresponding to contact tails 126 are grouped into signal conductor contacts $\mathbf{224}_1 \ldots \mathbf{224}_4$ and ground conductor contacts $\mathbf{234}_1 \ldots \mathbf{234}_4$.

In some embodiments, housing 260 may be provided with openings, such as windows or slots $\mathbf{264}_1 \ldots \mathbf{264}_6$, and holes, of which hole 262 is numbered, adjacent the signal conductors 420. These openings may serve multiple purposes, including to: (i) ensure during an injection molding process that the conductive elements are properly positioned, and (ii) facilitate insertion of materials that have different electrical properties, if so desired.

To obtain the desired performance characteristics, one embodiment of the present invention may employ regions of different dielectric constant selectively located adjacent signal conductors $\mathbf{310}_1$B, $\mathbf{310}_2$B . . . $\mathbf{310}_4$B of a wafer. For example, in the embodiment illustrated in FIGS. 2A-2C, the housing 260 includes slots $\mathbf{264}_1 \ldots \mathbf{264}_6$ in housing 260 that position air adjacent signal conductors $\mathbf{310}_1$B, $\mathbf{310}_2$B . . . $\mathbf{310}_4$B.

Figure 9:
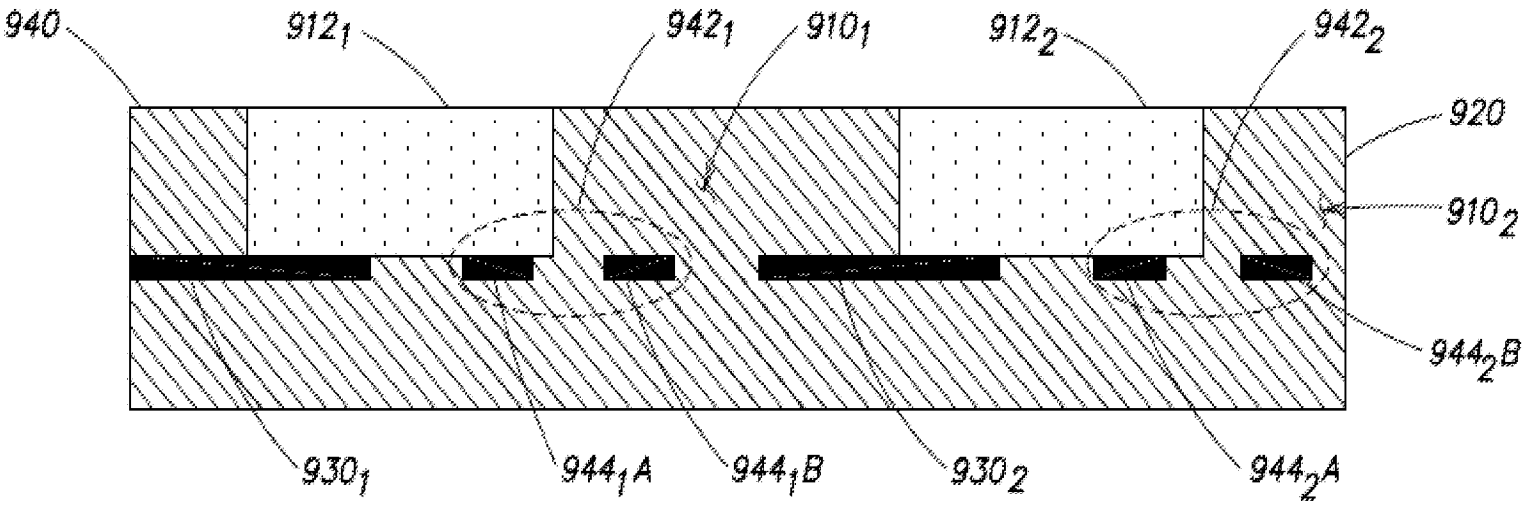
FIG. 9 is a cross-sectional representation of a wafer according to an alternative embodiment of the invention.

As shown, slots $\mathbf{264}_1 \ldots \mathbf{264}_6$ in housing 260 are formed adjacent as well as in between signal and ground conductors. For example, slot $\mathbf{264}_4$ is formed between signal conductor $\mathbf{310}_4$B and ground conductor $\mathbf{330}_4$. In other embodiments that are shown in FIG. 9, slots $\mathbf{264}_1 \ldots \mathbf{264}_6$ in housing 260 may be formed adjacent to but not in between signal and ground conductors. In this regard, a slot may by formed such that it runs up against adjacent signal and ground conductors, or in close proximity to adjacent signal and ground conductors, but is not located directly in between signal and ground conductors. Such a configuration may be more readily manufactured in an insert molding operation than a configuration in which a space is created in the relatively small gap between a signal and ground conductor. Though, molding housing 260 in this fashion may not provide the same electrical characteristics as molding a space directly between a signal and ground conductor. In such embodiments, other approaches as described below may be used instead of or in addition to forming regions of different dielectric constant to provide a desired electrical performance.

The ability to place air, or other material that has a dielectric constant lower than the dielectric constant of material used to form other portions of housing 260, in close proximity to one half of a differential pair provides a mechanism to de-skew a differential pair of signal conductors. The time it takes an electrical signal to propagate from one end of the signal connector to the other end is known as the propagation delay. In some embodiments, it is desirable that each signal within a pair have the same propagation delay, which is commonly referred to as having zero skew within the pair. The propagation delay within a conductor is influenced by the dielectric constant of material near the conductor, where a lower dielectric constant means a lower propagation delay. The dielectric constant is also sometimes referred to as the relative permittivity. A vacuum has the lowest possible dielectric constant with a value of 1. Air has a similarly low dielectric constant, whereas dielectric materials, such as LCP, have higher dielectric constants. For example, LCP has a dielectric constant of between about 2.5 and about 4.5.

Each signal conductor of the signal pair may have a different physical length, particularly in a right-angle connector. In some embodiments, to equalize the propagation delay in the signal conductors of a differential pair even though they have physically different lengths, the relative proportion of materials of different dielectric constants around the conductors may be adjusted. In some embodiments, more air is positioned in close proximity to the physically longer signal conductor of the pair than for the shorter signal conductor of the pair, thus lowering the effective dielectric constant around the signal conductor and decreasing its propagation delay.

However, as the dielectric constant is lowered, the impedance of the signal conductor rises. To maintain balanced impedance within the pair, the size of the signal conductor in closer proximity to the air may be increased in thickness or width. This results in two signal conductors with different physical geometry, but a more equal propagation delay and more inform impedance profile along the pair.

Figure 2C:
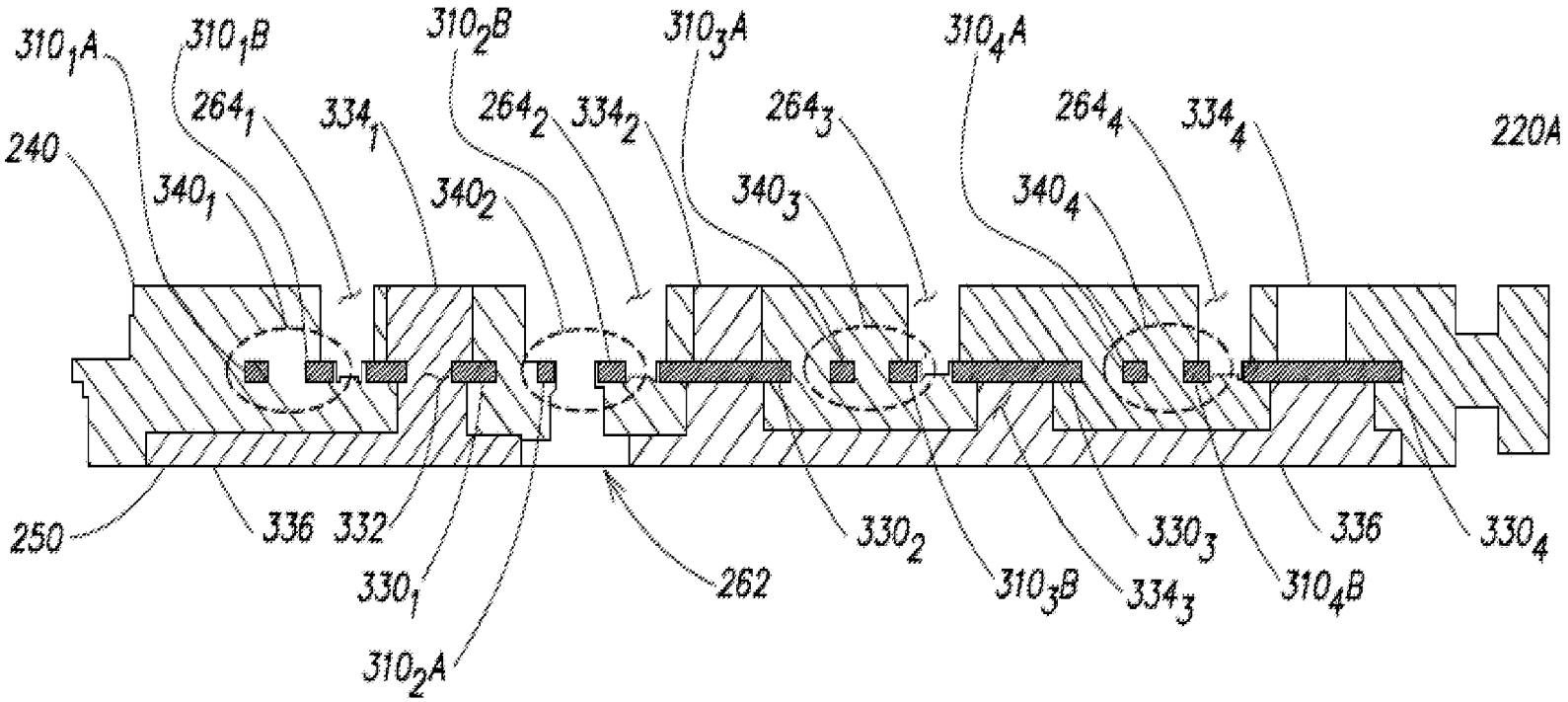
FIG. 2C is a cross-sectional representation of the wafer illustrated in FIG. 2B taken along the line 2C-2C.

FIG. 2C shows a wafer 220 in cross section taken along the line 2C-2C in FIG. 2B. As shown, a plurality of differential pairs $\mathbf{340}_1 \ldots \mathbf{340}_4$ are held in an array within insulative portion 240 of housing 260. In the illustrated embodiment, the array, in cross-section, is a linear array, forming a column of conductive elements.

Slots $\mathbf{264}_1 \ldots \mathbf{264}_4$ are intersected by the cross section and are therefore visible in FIG. 2C. As can be seen, slots $\mathbf{264}_1 \ldots \mathbf{264}_4$ create regions of air adjacent the longer conductor in each differential pair $\mathbf{340}_1$, $\mathbf{340}_2 \ldots \mathbf{340}_4$. Though, air is only one example of a material with a low dielectric constant that may be used for de-skewing a connector. Regions comparable to those occupied by slots $264_1$ . . . $264_4$ as shown in FIG. 2C could be formed with a plastic with a lower dielectric constant than the plastic used to form other portions of housing 260. As another example, regions of lower dielectric constant could be formed using different types or amounts of fillers. For example, lower dielectric constant regions could be molded from plastic having less glass fiber reinforcement than in other regions.

FIG. 2C also illustrates positioning and relative dimensions of signal and ground conductors that may be used in some embodiments. As shown in FIG. 2C, intermediate portions of the signal conductors $310_1$A . . . $310_4$A and $310_1$B . . . $310_4$B are embedded within housing 260 to form a column. Intermediate portions of ground conductors $330_1$ . . . $330_4$ may also be held within housing 260 in the same column.

Ground conductors $330_1$, $330_2$ and $330_3$ are positioned between two adjacent differential pairs $340_1$, $340_2$ . . . $340_4$ within the column. Additional ground conductors may be included at either or both ends of the column. In wafer 220A, as illustrated in FIG. 2C, a ground conductor $330_4$ is positioned at one end of the column. As shown in FIG. 2C, in some embodiments, each ground conductor $330_1$ . . . $330_4$ is preferably wider than the signal conductors of differential pairs $340_1$ . . . $340_4$. In the cross-section illustrated, the intermediate portion of each ground conductor has a width that is equal to or greater than three times the width of the intermediate portion of a signal conductor. In the pictured embodiment, the width of each ground conductor is sufficient to span at least the same distance along the column as a differential pair.

In the pictured embodiment, each ground conductor has a width approximately five times the width of a signal conductor such that in excess of 50% of the column width occupied by the conductive elements is occupied by the ground conductors. In the illustrated embodiment, approximately 70% of the column width occupied by conductive elements is occupied by the ground conductors $330_1$ . . . $330_4$. Increasing the percentage of each column occupied by a ground conductor can decrease cross talk within the connector.

Other techniques can also be used to manufacture wafer 220A to reduce crosstalk or otherwise have desirable electrical properties. In some embodiments, one or more portions of the housing 260 are formed from a material that selectively alters the electrical and/or electromagnetic properties of that portion of the housing, thereby suppressing noise and/or crosstalk, altering the impedance of the signal conductors or otherwise imparting desirable electrical properties to the signal conductors of the wafer.

In the embodiment illustrated in FIGS. 2A-2C, housing 260 includes an insulative portion 240 and a lossy portion 250. In one embodiment, the lossy portion 250 may include a thermoplastic material filled with conducting particles. The fillers make the portion "electrically lossy." In one embodiment, the lossy regions of the housing are configured to reduce crosstalk between at least two adjacent differential pairs $340_1$ . . . $340_4$. The insulative regions of the housing may be configured so that the lossy regions do not attenuate signals carried by the differential pairs $340_1$ . . . $340_4$ an undesirable amount.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz or up to 15 GHz or up to 25 GHz, or may operate at higher ranges, such as up to 30 GHz or 40 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 Siemens/meter. In some embodiments material with a bulk conductivity of between about 25 Siemens/meter and about 500 Siemens/meter may be used. As a specific example, material with a conductivity of about 50 Siemens/meter may be used.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in the lossy portion 250 of the housing may be disposed generally evenly throughout, rendering a conductivity of the lossy portion generally constant. In other embodiments, a first region of the lossy portion 250 may be more conductive than a second region of the lossy portion 250 so that the conductivity, and therefore amount of loss within the lossy portion 250 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which act as a reinforcement for the preform. Such a preform may be inserted in a wafer 220A to form all or part of the housing and may be positioned to adhere to ground conductors in the wafer. In some embodiments, the preform may adhere through the adhesive in the preform, which may be cured in a heat treating process. Various forms of reinforcing fiber, in woven or non-woven form, coated or non-coated, may be used. Non-woven carbon fiber is one suitable material. Other suitable materials, such as custom blends as sold by RTP Company, can be employed, as the present invention is not limited in this respect.

In the embodiment illustrated in FIG. 2C, the wafer housing 260 is molded with two types of material. In the pictured embodiment, lossy portion 250 is formed of a material having a conductive filler, whereas the insulative portion 240 is formed from an insulative material having little or no conductive fillers, though insulative portions may have fillers, such as glass fiber, that alter mechanical properties of the binder material or that impact other electrical properties, such as dielectric constant, of the binder. In one embodiment, the insulative portion 240 is formed of molded plastic and the lossy portion is formed of molded plastic with conductive fillers. In some embodiments, the lossy portion 250 is sufficiently lossy that it attenuates radiation between differential pairs by a sufficient amount that crosstalk is reduced to a level that a separate metal plate is not required.

To prevent signal conductors $\mathbf{310}_1$A, $\mathbf{310}_1$B . . . $\mathbf{310}_4$A, and $\mathbf{310}_4$B from being shorted together and/or from being shorted to ground by lossy portion 250, insulative portion 240, formed of a suitable dielectric material, may be used to insulate the signal conductors. The insulative materials may be, for example, a thermoplastic binder into which non-conducting fibers are introduced for added strength, dimensional stability and to reduce the amount of higher priced binder used. Glass fibers, as in a conventional electrical connector, may have a loading of about 30% by volume. It should be appreciated that in other embodiments, other materials may be used, as the invention is not so limited.

In the embodiment of FIG. 2C, the lossy portion 250 includes a parallel region 336 and perpendicular regions $\mathbf{334}_1$ . . . $\mathbf{334}_4$. In one embodiment, perpendicular regions $\mathbf{334}_1$ . . . $\mathbf{334}_4$ are disposed between adjacent conductive elements that form separate differential pairs $\mathbf{340}_1$ . . . $\mathbf{340}_4$.

In some embodiments, the lossy regions 336 and $\mathbf{334}_1$ . . . $\mathbf{334}_4$ of the housing 260 and the ground conductors $\mathbf{330}_1$ . . . $\mathbf{330}_4$ cooperate to shield the differential pairs $\mathbf{340}_1$ . . . $\mathbf{340}_4$ to reduce crosstalk. The lossy regions 336 and $\mathbf{334}_1$ . . . $\mathbf{334}_4$ may be grounded by being electrically connected to one or more ground conductors. This configuration of lossy material in combination with ground conductors $\mathbf{330}_1$ . . . $\mathbf{330}_4$ reduces crosstalk between differential pairs within a column.

As shown in FIG. 2C, portions of the ground conductors $\mathbf{330}_1$ . . . $\mathbf{330}_4$, may be electrically connected to regions 336 and $\mathbf{334}_1$ . . . $\mathbf{334}_4$ by molding portion 250 around ground conductors $\mathbf{340}_1$ . . . $\mathbf{340}_4$. In some embodiments, ground conductors may include openings through which the material forming the housing can flow during molding. For example, the cross section illustrated in FIG. 2C is taken through an opening 332 in ground conductor $\mathbf{330}_1$. Though not visible in the cross section of FIG. 2C, other openings in other ground conductors such as $\mathbf{330}_2$ . . . $\mathbf{330}_4$ may be included.

Material that flows through openings in the ground conductors allows perpendicular portions $\mathbf{334}_1$ . . . $\mathbf{334}_4$ to extend through ground conductors even though a mold cavity used to form a wafer 220A has inlets on only one side of the ground conductors. Additionally, flowing material through openings in ground conductors as part of a molding operation may aid in securing the ground conductors in housing 260 and may enhance the electrical connection between the lossy portion 250 and the ground conductors. However, other suitable methods of forming perpendicular portions $\mathbf{334}_1$ . . . $\mathbf{334}_4$ may also be used, including molding wafer 320A in a cavity that has inlets on two sides of ground conductors $\mathbf{330}_1$ . . . $\mathbf{330}_4$. Likewise, other suitable methods for securing the ground contacts 330 may be employed, as the present invention is not limited in this respect.

Forming the lossy portion 250 of the housing from a moldable material can provide additional benefits. For example, the lossy material at one or more locations can be configured to set the performance of the connector at that location. For example, changing the thickness of a lossy portion to space signal conductors closer to or further away from the lossy portion 250 can alter the performance of the connector. As such, electromagnetic coupling between one differential pair and ground and another differential pair and ground can be altered, thereby configuring the amount of loss for radiation between adjacent differential pairs and the amount of loss to signals carried by those differential pairs. As a result, a connector according to embodiments of the invention may be capable of use at higher frequencies than conventional connectors, such as for example at frequencies between 10-15 GHz.

As shown in the embodiment of FIG. 2C, wafer 220A is designed to carry differential signals. Thus, each signal is carried by a pair of signal conductors $\mathbf{310}_1$A and $\mathbf{310}_1$B, . . . $\mathbf{310}_4$A, and $\mathbf{310}_4$B. Preferably, each signal conductor is closer to the other conductor in its pair than it is to a conductor in an adjacent pair. For example, a pair $\mathbf{340}_1$ carries one differential signal, and pair $\mathbf{340}_2$ carries another differential signal. As can be seen in the cross section of FIG. 2C, signal conductor $\mathbf{310}_1$B is closer to signal conductor $\mathbf{310}_1$A than to signal conductor $\mathbf{310}_2$A. Perpendicular lossy regions $\mathbf{334}_1$ . . . $\mathbf{334}_4$ may be positioned between pairs to provide shielding between the adjacent differential pairs in the same column.

Figure 3:
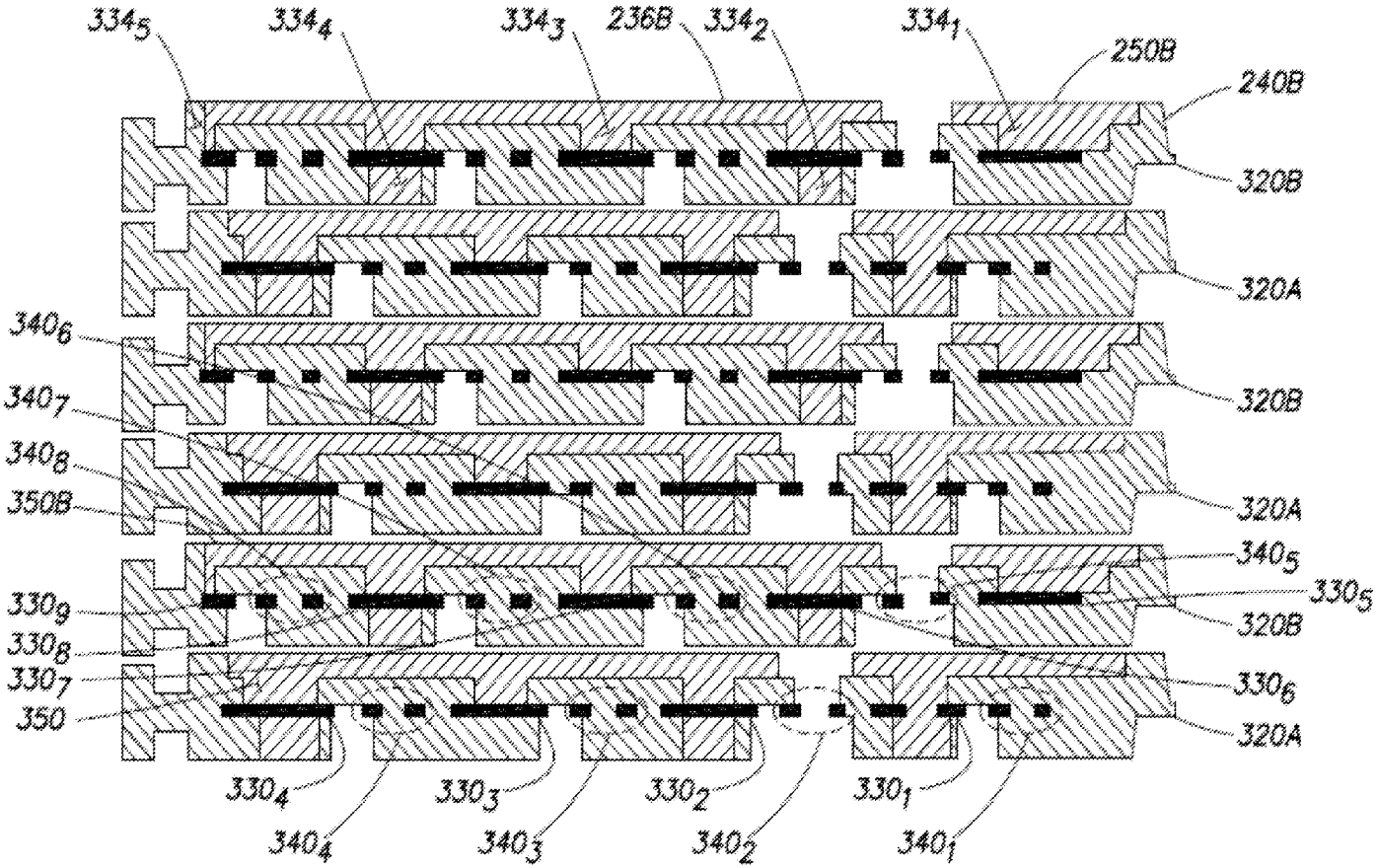
FIG. 3 is a cross-sectional representation of a plurality of wafers stacked together according to an embodiment of the present invention.

Lossy material may also be positioned to reduce the crosstalk between adjacent pairs in different columns. FIG. 3 illustrates a cross-sectional view similar to FIG. 2C but with a plurality of subassemblies or wafers 320A, 320B aligned side to side to form multiple parallel columns.

As illustrated in FIG. 3, the plurality of signal conductors 340 may be arranged in differential pairs in a plurality of columns formed by positioning wafers side by side. It is not necessary that each wafer be the same and different types of wafers may be used. It may be desirable for all types of wafers used to construct a daughter card connector to have an outer envelope of approximately the same dimensions so that all wafers fit within the same enclosure or can be attached to the same support member, such as stiffener 128 (FIG. 1). However, by providing different placement of the signal conductors, ground conductors and lossy portions in different wafers, the amount that the lossy material reduces crosstalk relative for the amount that it attenuates signals may be more readily configured. In one embodiment, two types of wafers are used, which are illustrated in FIG. 3 as subassemblies or wafers 320A and 320B.

Each of the wafers 320B may include structures similar to those in wafer 320A as illustrated in FIGS. 2A, 2B and 2C. As shown in FIG. 3, wafers 320B include multiple differential pairs, such as pairs $\mathbf{340}_5$, $\mathbf{340}_6$, $\mathbf{340}_7$ and $\mathbf{340}_8$. The signal pairs may be held within an insulative portion, such as 240B of a housing. Slots or other structures (not numbered) may be formed within the housing for skew equalization in the same way that slots $\mathbf{264}_1 \ldots \mathbf{264}_6$ are formed in a wafer 220A.

The housing for a wafer 320B may also include lossy portions, such as lossy portions 250B. As with lossy portions 250 described in connection with wafer 320A in FIG. 2C, lossy portions 250B may be positioned to reduce crosstalk between adjacent differential pairs. The lossy portions 250B may be shaped to provide a desirable level of crosstalk suppression without causing an undesired amount of signal attenuation.

In the embodiment illustrated, lossy portion 250B may have a substantially parallel region 336B that is parallel to the columns of differential pairs $\mathbf{340}_5 \ldots \mathbf{340}_8$. Each lossy portion 250B may further include a plurality of perpendicular regions $\mathbf{334}_1$B . . . $\mathbf{334}_5$B, which extend from the parallel region 336B. The perpendicular regions $\mathbf{334}_1$B . . . $\mathbf{334}_5$B may be spaced apart and disposed between adjacent differential pairs within a column.

Wafers 320B also include ground conductors, such as ground conductors $\mathbf{330}_5 \ldots \mathbf{330}_9$. As with wafers 320A, the ground conductors are positioned adjacent differential pairs $\mathbf{340}_5 \ldots \mathbf{340}_8$. Also, as in wafers 320A, the ground conductors generally have a width greater than the width of the signal conductors. In the embodiment pictured in FIG. 3, ground conductors $\mathbf{330}_5 \ldots \mathbf{330}_8$ have generally the same shape as ground conductors $\mathbf{330}_1 \ldots \mathbf{330}_4$ in a wafer 320A. However, in the embodiment illustrated, ground conductor $\mathbf{330}_9$ has a width that is less than the ground conductors $\mathbf{330}_5 \ldots \mathbf{330}_8$ in wafer 320B.

Ground conductor $\mathbf{330}_9$ is narrower to provide desired electrical properties without requiring the wafer 320B to be undesirably wide. Ground conductor $\mathbf{330}_9$ has an edge that faces differential pair $\mathbf{340}_8$. Accordingly, differential pair $\mathbf{340}_8$ is positioned relative to a ground conductor similarly to adjacent differential pairs, such as differential pair $\mathbf{330}_8$ in wafer 320B or pair $\mathbf{340}_4$ in a wafer 320A. As a result, the electrical properties of differential pair $\mathbf{340}_8$ are similar to those of other differential pairs. By making ground conductor $\mathbf{330}_9$ narrower than ground conductors $\mathbf{330}_8$ or $\mathbf{330}_4$, wafer 320B may be made with a smaller size.

A similar small ground conductor could be included in wafer 320A adjacent pair $\mathbf{340}_1$. However, in the embodiment illustrated, pair $\mathbf{340}_1$ is the shortest of all differential pairs within daughter card connector 120. Though including a narrow ground conductor in wafer 320A could make the ground configuration of differential pair $\mathbf{340}_1$ more similar to the configuration of adjacent differential pairs in wafers 320A and 320B, the net effect of differences in ground configuration may be proportional to the length of the conductor over which those differences exist. Because differential pair $\mathbf{340}_1$ is relatively short, in the embodiment of FIG. 3, a second ground conductor adjacent to differential pair $\mathbf{340}_1$, though it would change the electrical characteristics of that pair, may have relatively little net effect. However, in other embodiments, a further ground conductor may be included in wafers 320A.

FIG. 3 illustrates a further feature possible when using multiple types of wafers to form a daughter card connector. Because the columns of contacts in wafers 320A and 320B have different configurations, when wafer 320A is placed side by side with wafer 320B, the differential pairs in wafer 320A are more closely aligned with ground conductors in wafer 320B than with adjacent pairs of signal conductors in wafer 320B. Conversely, the differential pairs of wafer 320B are more closely aligned with ground conductors than adjacent differential pairs in the wafer 320A.

For example, differential pair $\mathbf{340}_6$ is proximate ground conductor $\mathbf{330}_2$ in wafer 320A. Similarly, differential pair $\mathbf{340}_3$ in wafer 320A is proximate ground conductor $\mathbf{330}_7$ in wafer 320B. In this way, radiation from a differential pair in one column couples more strongly to a ground conductor in an adjacent column than to a signal conductor in that column. This configuration reduces crosstalk between differential pairs in adjacent columns.

Wafers with different configurations may be formed in any suitable way. FIG. 4A illustrates a step in the manufacture of wafers 320A and 320B according to one embodiment. In the illustrated embodiment, wafer strip assemblies, each containing conductive elements in a configuration desired for one column of a daughter card connector, are formed. A housing is then molded around the conductive elements in each wafer strip assembly in an insert molding operation to form a wafer.

To facilitate the manufacture of wafers, signal conductors, of which signal conductor 420 is numbered, and ground conductors, of which ground conductor 430 is numbered, may be held together on a lead frame 400 as shown in FIG. 4A. As shown, the signal conductors 420 and the ground conductors 430 are attached to one or more carrier strips 402. In one embodiment, the signal conductors and ground conductors are stamped for many wafers on a single sheet. The sheet may be metal or may be any other material that is conductive and provides suitable mechanical properties for making a conductive element in an electrical connector. Phosphor-bronze, beryllium copper and other copper alloys are examples of materials that may be used.

FIG. 4A illustrates a portion of a sheet of metal in which wafer strip assemblies 410A, 410B have been stamped. Wafer strip assemblies 410A, 410B may be used to form wafers 320A and 320B, respectively. Conductive elements may be retained in a desired position on carrier strips 402. The conductive elements may then be more readily handled during manufacture of wafers. Once material is molded around the conductive elements, the carrier strips may be severed to separate the conductive elements. The wafers may then be assembled into daughter board connectors of any suitable size.

FIG. 4A also provides a more detailed view of features of the conductive elements of the daughter card wafers. The width of a ground conductor, such as ground conductor 430, relative to a signal conductor, such as signal conductor 420, is apparent. Also, openings in ground conductors, such as opening 332, are visible.

The wafer strip assemblies shown in FIG. 4A provide just one example of a component that may be used in the manufacture of wafers. For example, in the embodiment illustrated in FIG. 4A, the lead frame 400 includes tie bars 452, 454 and 456 that connect various portions of the signal conductors 420 and/or ground strips 430 to the lead frame 400. These tie bars may be severed during subsequent manufacturing processes to provide electronically separate conductive elements. A sheet of metal may be stamped such that one or more additional carrier strips are formed at other locations and/or bridging members between conductive elements may be employed for positioning and support of the conductive elements during manufacture. Accordingly, the details shown in FIG. 4A are illustrative and not a limitation on the invention.

Although the lead frame 400 is shown as including both ground conductors 430 and the signal conductors 420, the present invention is not limited in this respect. For example, the respective conductors may be formed in two separate lead frames. Indeed, no lead frame need be used and individual conductive elements may be employed during manufacture. It should be appreciated that molding over one or both lead frames or the individual conductive elements need not be performed at all, as the wafer may be assembled by inserting ground conductors and signal conductors into preformed housing portions, which may then be secured together with various features including snap fit features.

Figure 4B:
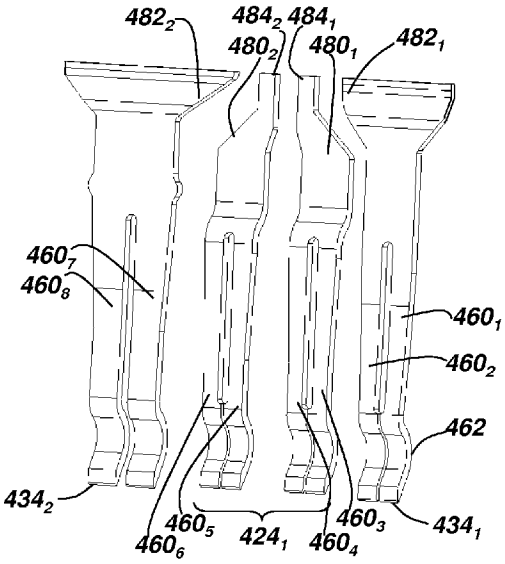
FIG. 4B is an enlarged detail view of the area encircled by arrow 4B-4B in FIG. 4A.
Figure 4A:
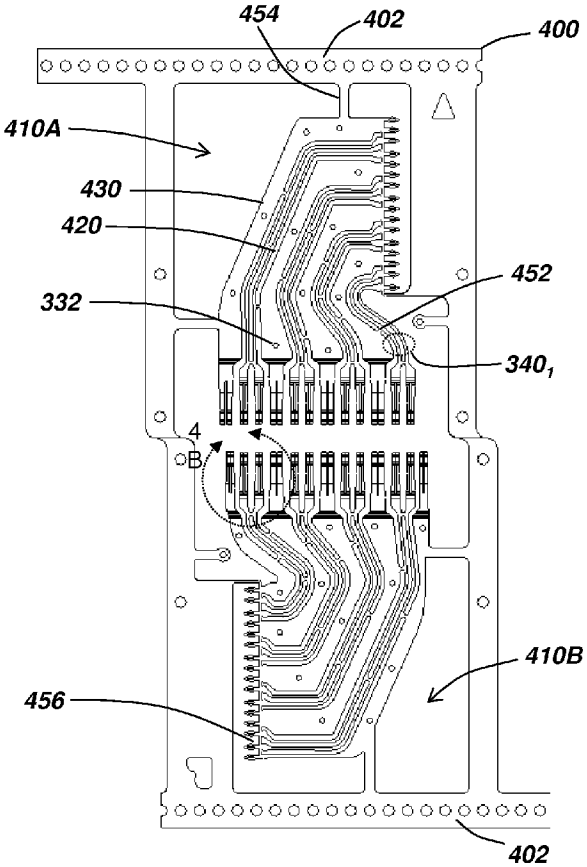
FIG. 4A is a plan view of a lead frame used in the manufacture of a connector according to an embodiment of the invention.

FIG. 4B illustrates a detailed view of the mating contact end of a differential pair $\mathbf{424}_1$ positioned between two ground mating contacts $\mathbf{434}_1$ and $\mathbf{434}_2$. As illustrated, the ground conductors may include mating contacts of different sizes. The embodiment pictured has a large mating contact $\mathbf{434}_2$ and a small mating contact $\mathbf{434}_1$. To reduce the size of each wafer, small mating contacts $\mathbf{434}_1$ may be positioned on one or both ends of the wafer.

FIG. 4B illustrates features of the mating contact portions of the conductive elements within the wafers forming daughter board connector 120. FIG. 4B illustrates a portion of the mating contacts of a wafer configured as wafer 320B. The portion shown illustrates a mating contact $\mathbf{434}_1$ such as may be used at the end of a ground conductor $\mathbf{330}_9$ (FIG. 3). Mating contacts $\mathbf{424}_1$ may form the mating contact portions of signal conductors, such as those in differential pair $\mathbf{340}_8$ (FIG. 3). Likewise, mating contact $\mathbf{434}_2$ may form the mating contact portion of a ground conductor, such as ground conductor $\mathbf{330}_8$ (FIG. 3).

In the embodiment illustrated in FIG. 4B, each of the mating contacts on a conductive element in a daughter card wafer is a dual beam contact. Mating contact $\mathbf{434}_1$ includes beams $\mathbf{460}_1$ and $\mathbf{460}_2$. Mating contacts $\mathbf{424}_1$ includes four beams, two for each of the signal conductors of the differential pair terminated by mating contacts $\mathbf{424}_1$. In the illustration of FIG. 4B, beams $\mathbf{460}_3$ and $\mathbf{460}_4$ provide two beams for a contact for one signal conductor of the pair and beams $\mathbf{460}_5$ and $\mathbf{460}_6$ provide two beams for a contact for a second signal conductor of the pair. Likewise, mating contact $\mathbf{434}_2$ includes two beams $\mathbf{460}_7$ and $\mathbf{460}_8$.

Each of the beams includes a mating surface, of which mating surface 462 on beam $\mathbf{460}_1$ is numbered. To form a reliable electrical connection between a conductive element in the daughter card connector 120 and a corresponding conductive element in backplane connector 150, each of the beams $\mathbf{460}_1$ . . . $\mathbf{460}_8$ may be shaped to press against a corresponding mating contact in the backplane connector 150 with sufficient mechanical force to create a reliable electrical connection. Having two beams per contact increases the likelihood that an electrical connection will be formed even if one beam is damaged, contaminated or otherwise precluded from making an effective connection.

Each of beams $\mathbf{460}_1$ . . . $\mathbf{460}_8$ has a shape that generates mechanical force for making an electrical connection to a corresponding contact. In the embodiment of FIG. 4B, the signal conductors terminating at mating contact $\mathbf{424}_1$ may have relatively narrow intermediate portions $\mathbf{484}_1$ and $\mathbf{484}_2$ within the housing of wafer 320D. However, to form an effective electrical connection, the mating contact portions $\mathbf{424}_1$ for the signal conductors may be wider than the intermediate portions $\mathbf{484}_1$ and $\mathbf{484}_2$. Accordingly, FIG. 4B shows broadening portions $\mathbf{480}_1$ and $\mathbf{480}_2$ associated with each of the signal conductors.

In the illustrated embodiment, the ground conductors adjacent broadening portions $\mathbf{480}_1$ and $\mathbf{480}_2$ are shaped to conform to the adjacent edge of the signal conductors. Accordingly, mating contact $\mathbf{434}_1$ for a ground conductor has a complementary portion $\mathbf{482}_1$ with a shape that conforms to broadening portion $\mathbf{480}_1$. Likewise, mating contact $\mathbf{434}_2$ has a complementary portion $\mathbf{482}_2$ that conforms to broadening portion $\mathbf{480}_2$. By incorporating complementary portions in the ground conductors, the edge-to-edge spacing between the signal conductors and adjacent ground conductors remains relatively constant, even as the width of the signal conductors change at the mating contact region to provide desired mechanical properties to the beams. Maintaining a uniform spacing may further contribute to desirable electrical properties for an interconnection system according to an embodiment of the invention.

Some or all of the construction techniques employed within daughter card connector 120 for providing desirable characteristics may be employed in backplane connector 150. In the illustrated embodiment, backplane connector 150, like daughter card connector 120, includes features for providing desirable signal transmission properties. Signal conductors in backplane connector 150 are arranged in columns, each containing differential pairs interspersed with ground conductors. The ground conductors are wide relative to the signal conductors. Also, adjacent columns have different configurations. Some of the columns may have narrow ground conductors at the end to save space while providing a desired ground configuration around signal conductors at the ends of the columns. Additionally, ground conductors in one column may be positioned adjacent to differential pairs in an adjacent column as a way to reduce crosstalk from one column to the next. Further, lossy material may be selectively placed within the shroud of backplane connector 150 to reduce crosstalk, without providing an undesirable level attenuation for signals. Further, adjacent signals and grounds may have conforming portions so that in locations where the profile of either a signal conductor or a ground conductor changes, the signal-to-ground spacing may be maintained.

Figure 5B:
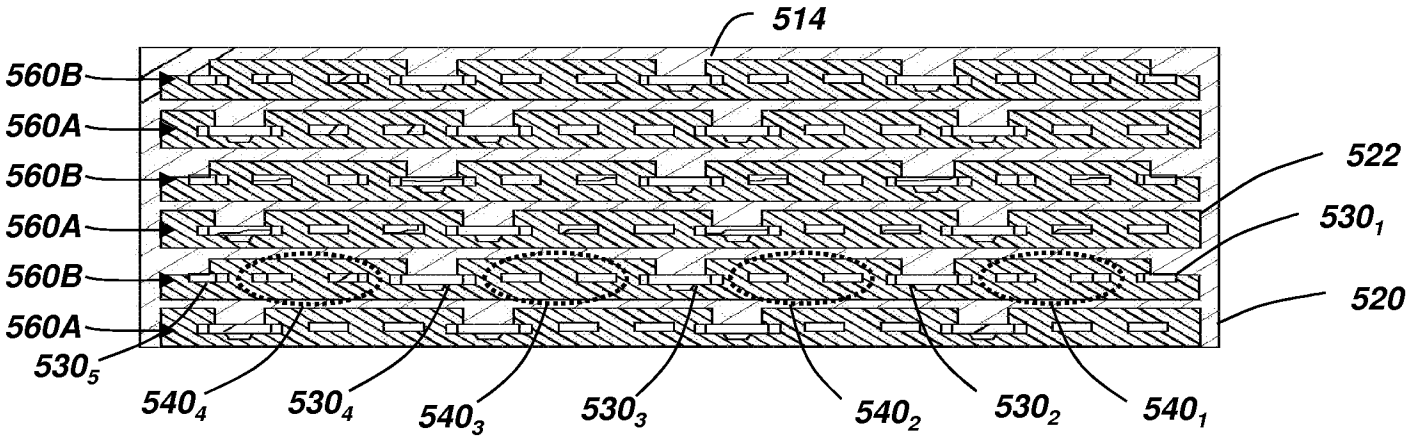
FIG. 5B is a cross-sectional representation of the backplane connector illustrated in FIG. 5A taken along the line 5B-5B.

FIGS. 5A-5B illustrate an embodiment of a backplane connector 150 in greater detail. In the illustrated embodiment, backplane connector 150 includes a shroud 510 with walls 512 and floor 514. Conductive elements are inserted into shroud 510. In the embodiment shown, each conductive element has a portion extending above floor 514. These portions form the mating contact portions of the conductive elements, collectively numbered 154. Each conductive element has a portion extending below floor 514. These portions form the contact tails and are collectively numbered 156.

The conductive elements of backplane connector 150 are positioned to align with the conductive elements in daughter card connector 120. Accordingly, FIG. 5A shows conductive elements in backplane connector 150 arranged in multiple parallel columns. In the embodiment illustrated, each of the parallel columns includes multiple differential pairs of signal conductors, of which differential pairs $\mathbf{540}_1$, $\mathbf{540}_2$ . . . $\mathbf{540}_4$ are numbered. Each column also includes multiple ground conductors. In the embodiment illustrated in FIG. 5A, ground conductors $\mathbf{530}_1$, $\mathbf{530}_2$ . . . $\mathbf{530}_5$ are numbered.

Ground conductors $\mathbf{530}_1$ . . . $\mathbf{530}_5$ and differential pairs $\mathbf{540}_1$ . . . $\mathbf{540}_4$ are positioned to form one column of conductive elements within backplane connector 150. That column has conductive elements positioned to align with a column of conductive elements as in a wafer 320B (FIG. 3). An adjacent column of conductive elements within backplane connector 150 may have conductive elements positioned to align with mating contact portions of a wafer 320A. The columns in backplane connector 150 may alternate configurations from column to column to match the alternating pattern of wafers 320A, 320B shown in FIG. 3.

Ground conductors $\mathbf{530}_2$, $\mathbf{530}_3$ and $\mathbf{530}_4$ are shown to be wide relative to the signal conductors that make up the differential pairs by $\mathbf{540}_1$ . . . $\mathbf{540}_4$. Narrower ground conductive elements, which are narrower relative to ground conductors $\mathbf{530}_2$, $\mathbf{530}_3$ and $\mathbf{530}_4$, are included at each end of the column. In the embodiment illustrated in FIG. 5A, narrower ground conductors $\mathbf{530}_1$ and $\mathbf{530}_5$ are including at the ends of the column containing differential pairs $\mathbf{540}_1$ . . . $\mathbf{540}_4$ and may, for example, mate with a ground conductor from daughter card 120 with a mating contact portion shaped as mating contact $\mathbf{434}_1$ (FIG. 4B)..

FIG. 5B shows a view of backplane connector 150 taken along the line labeled B-B in FIG. 5A. In the illustration of FIG. 5B, an alternating pattern of columns of 560A-560B is visible. A column containing differential pairs $\mathbf{540}_1$ . . . $\mathbf{540}_4$ is shown as column 560B.

FIG. 5B shows that shroud 510 may contain both insulative and lossy regions. In the illustrated embodiment, each of the conductive elements of a differential pair, such as differential pairs $\mathbf{540}_1$ . . . $\mathbf{540}_4$, is held within an insulative region 522. Lossy regions 520 may be positioned between adjacent differential pairs within the same column and between adjacent differential pairs in adjacent columns. Lossy regions 520 may connect to the ground contacts such as $\mathbf{530}_1$ . . . $\mathbf{530}_5$. Sidewalls 512 may be made of either insulative or lossy material.

FIGS. 6A, 6B and 6C illustrate in greater detail conductive elements that may be used in forming backplane connector 150. FIG. 6A shows multiple wide ground contacts $\mathbf{530}_2$, $\mathbf{530}_3$ and $\mathbf{530}_4$. In the configuration shown in FIG. 6A, the ground contacts are attached to a carrier strip 620. The ground contacts may be stamped from a long sheet of metal or other conductive material, including a carrier strip 620. The individual contacts may be severed from carrier strip 620 at any suitable time during the manufacturing operation.

As can be seen, each of the ground contacts has a mating contact portion shaped as a blade. For additional stiffness, one or more stiffening structures may be formed in each contact. In the embodiment of FIG. 6A, a rib, such as a rib 610 is formed in each of the wide ground conductors.

Each of the wide ground conductors, such as $\mathbf{530}_2$ . . . $\mathbf{530}_4$, includes two contact tails. For ground conductor $\mathbf{530}_2$ contact tails $\mathbf{656}_1$ and $\mathbf{656}_2$ are numbered. Providing two contact tails per wide ground conductor provides for a more even distribution of grounding structures throughout the entire interconnection system, including within backplane 160 because each of contact tails $\mathbf{656}_1$ and $\mathbf{656}_2$ will engage a ground via within backplane 160 that will be parallel and adjacent a via carrying a signal. FIG. 4A illustrates that two ground contact tails may also be used for each ground conductor in daughter card connector.

FIG. 6B shows a stamping containing narrower ground conductors, such as ground conductors $\mathbf{530}_1$ and $\mathbf{530}_5$. As with the wider ground conductors shown in FIG. 6A, the narrower ground conductors of FIG. 6B have a mating contact portion shaped like a blade.

As with the stamping of FIG. 6A, the stamping of FIG. 6B containing narrower grounds includes a carrier strip 630 to facilitate handling of the conductive elements. The individual ground conductors may be severed from carrier strip 630 at any suitable time, either before or after insertion into backplane connector shroud 510.

In the embodiment illustrated, each of the narrower ground conductors, such as $\mathbf{530}_1$ and $\mathbf{530}_2$, contains a single contact tail such as $\mathbf{656}_3$ on ground conductor $\mathbf{530}_1$ or contact tail $\mathbf{656}_4$ on ground conductor $\mathbf{530}_5$. Even though only one ground contact tail is included, the relationship between number of signal contacts is maintained because narrow ground conductors as shown in FIG. 6B are used at the ends of columns where they are adjacent a single signal conductor. As can be seen from the illustration in FIG. 6B, each of the contact tails for a narrower ground conductor is offset from the center line of the mating contact in the same way that contact tails $\mathbf{656}_1$ and $\mathbf{656}_2$ are displaced from the center line of wide contacts. This configuration may be used to preserve the spacing between a ground contact tail and an adjacent signal contact tail.

As can be seen in FIG. 5A, in the pictured embodiment of backplane connector 150, the narrower ground conductors, such as $\mathbf{530}_1$ and $\mathbf{530}_5$, are also shorter than the wider ground conductors such as $\mathbf{530}_2$ . . . $\mathbf{530}_4$. The narrower ground conductors shown in FIG. 6B do not include a stiffening structure, such as ribs 610 (FIG. 6A). However, embodiments of narrower ground conductors may be formed with stiffening structures.

FIG. 6C shows signal conductors that may be used to form backplane connector 150. The signal conductors in FIG. 6C, like the ground conductors of FIGS. 6A and 6B, may be stamped from a sheet of metal. In the embodiment of FIG. 6C, the signal conductors are stamped in pairs, such as pairs $\mathbf{540}_1$ and $\mathbf{540}_2$. The stamping of FIG. 6C includes a carrier strip 640 to facilitate handling of the conductive elements. The pairs, such as $\mathbf{540}_1$ and $\mathbf{540}_2$, may be severed from carrier strip 640 at any suitable point during manufacture.

As can be seen from FIGS. 5A, 6A, 6B and 6C, the signal conductors and ground conductors for backplane connector 150 may be shaped to conform to each other to maintain a consistent spacing between the signal conductors and ground conductors. For example, ground conductors have projections, such as projection 660, that position the ground conductor relative to floor 514 of shroud 510. The signal conductors have complimentary portions, such as complimentary portion 662 (FIG. 6C) so that when a signal conductor is inserted into shroud 510 next to a ground conductor, the spacing between the edges of the signal conductor and the ground conductor stays relatively uniform, even in the vicinity of projections 660.

Likewise, signal conductors have projections, such as projections 664 (FIG. 6C). Projection 664 may act as a retention feature that holds the signal conductor within the floor 514 of backplane connector shroud 510 (FIG. 5A). Ground conductors may have complimentary portions, such as complementary portion 666 (FIG. 6A). When a signal conductor is placed adjacent a ground conductor, complimentary portion 666 maintains a relatively uniform spacing between the edges of the signal conductor and the ground conductor, even in the vicinity of projection 664.

FIGS. 6A, 6B and 6C illustrate examples of projections in the edges of signal and ground conductors and corresponding complimentary portions formed in an adjacent signal or ground conductor. Other types of projections may be formed and other shapes of complementary portions may likewise be formed.

To facilitate use of signal and ground conductors with complementary portions, backplane connector 150 may be manufactured by inserting signal conductors and ground conductors into shroud 510 from opposite sides. As can be seen in FIG. 5A, projections such as 660 (FIG. 6A) of ground conductors press against the bottom surface of floor 514. Backplane connector 150 may be assembled by inserting the ground conductors into shroud 510 from the bottom until projections 660 engage the underside of floor 514. Because signal conductors in backplane connector 150 are generally complementary to the ground conductors, the signal conductors have narrow portions adjacent the lower surface of floor 514. The wider portions of the signal conductors are adjacent the top surface of floor 514. Because manufacture of a backplane connector may be simplified if the conductive elements are inserted into shroud 510 narrow end first, backplane connector 150 may be assembled by inserting signal conductors into shroud 510 from the upper surface of floor 514. The signal conductors may be inserted until projections, such as projection 664, engage the upper surface of the floor. Two-sided insertion of conductive elements into shroud 510 facilitates manufacture of connector portions with conforming signal and ground conductors.

Figure 7A:
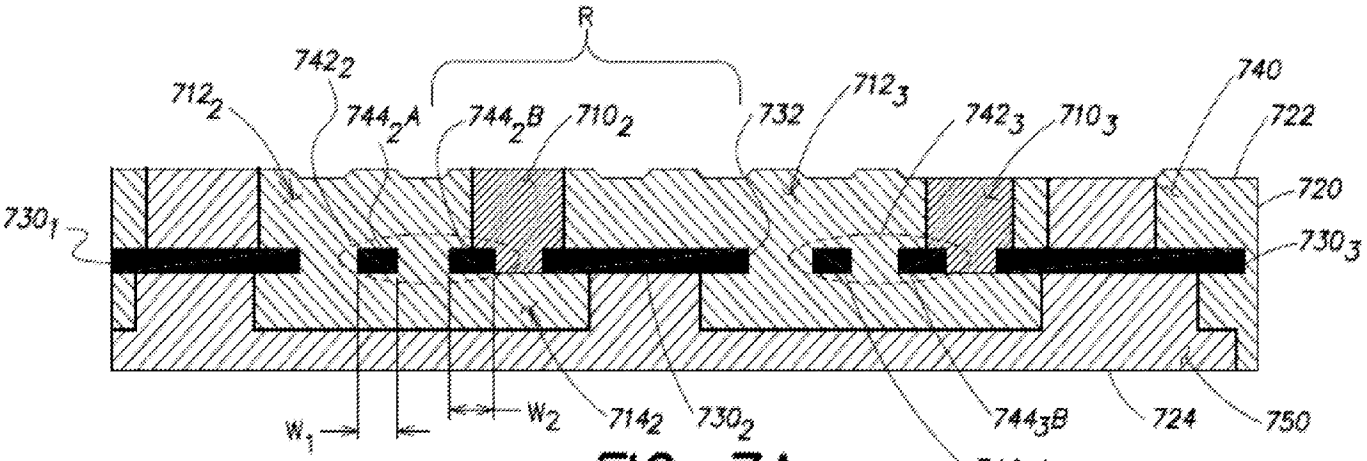
FIG. 7A is a cross-sectional representation of a portion of a wafer according to an embodiment of the present invention.

FIG. 7A illustrates additional details of construction techniques that may used to improve electrical properties of a differential connector. FIG. 7A shows a cross-section of a wafer 720. As with wafer 220A shown in FIG. 2C, wafer 720 includes a housing with an insulative portion 740 and a lossy portion 750.

A column of conductive elements is held within the housing of wafer 720. FIG. 7 shows two pairs, $\mathbf{742}_2$ and $\mathbf{742}_3$, of the signal conductors in the column. Three ground conductors, $\mathbf{730}_1$, $\mathbf{730}_2$ and $\mathbf{730}_3$ are also shown. Wafer 720 may have more or fewer conductive elements. Two signal pairs and three ground conductors are shown for simplicity of illustration, but the number of conductive elements in a column is not a limitation on the invention.

In the example of FIG. 7A, wafer 720 is configured for use in a right angle connector, which causes each differential pair to have at least one curved portion to enable the pairs to carry signals between orthogonal edges of the connector. Such a configuration results in the signal conductors of the pairs having different lengths, at least in the curved portions. These differences in the lengths of the conductors of a differential pair can cause skew. More generally, skew can occur within any differential pair configured so that a conductor of the differential pair is longer than the other and the specific configuration of the connector is not a limitation of the invention.

In the embodiment illustrated, signal conductor $\mathbf{744}_2$B is longer than signal conductor $\mathbf{744}_2$A in pair $\mathbf{742}_2$. Likewise, signal conductor $\mathbf{744}_3$B is longer than signal conductor $\mathbf{744}_3$A in pair $\mathbf{742}_3$. To reduce skew, the propagation speed of signals through the longer signal conductor may be increased relative to the propagation speed in the shorter signal conductor of the pair. Selective placement of regions of material with different dielectric constant may provide the desired relative propagation speed.

In the embodiment illustrated, for each of the pairs $\mathbf{742}_2$ and $\mathbf{742}_3$, a region of relatively low dielectric material may be incorporated into wafer 720 in the vicinity of each of the longer signal conductors. In the embodiment illustrated, regions $\mathbf{710}_2$ and $\mathbf{710}_3$ are incorporated into wafer 720. In contrast, the housing of wafer 720 in the vicinity of the shorter signal conductor of each pair creates regions of relatively higher dielectric constant material. In the embodiment of FIG. 7A, regions $\mathbf{712}_2$ and $\mathbf{712}_3$ of higher dielectric constant material are shown adjacent signal conductors $\mathbf{744}_2$A and $\mathbf{744}_3$A.

Similarly to that described above, and as shown in FIG. 7A, regions $\mathbf{710}_2$ and $\mathbf{710}_3$ are formed adjacent as well as in between signal and ground conductors, for example, $\mathbf{710}_3$ formed between signal conductor $\mathbf{744}_3$B and ground conductor $\mathbf{730}_3$. In other embodiments that are shown in FIG. 9, regions $\mathbf{710}_2$ and $\mathbf{710}_3$ may be formed adjacent to but not in between signal and ground conductors. In this regard, a region may by formed such that it runs up against adjacent signal and ground conductors, or in close proximity to adjacent signal and ground conductors, but is not located directly in between signal and ground conductors. As a result, in a cross-sectional view, regions $\mathbf{710}_2$ and $\mathbf{710}_3$ may appear in a rectangular shape without the protrusion into the space between signal and ground conductors. It can be appreciated that regions $\mathbf{710}_2$ and $\mathbf{710}_3$ are not required to be rectangular in shape, but can be formed in any suitable configuration, such as, for example, with angled or curved edges.

Regions of lower dielectric constant material and higher dielectric constant material may be formed in any suitable way. In embodiments in which the insulative portions of the housing for wafer 720 are molded from plastic filled with glass fiber loaded to approximately 30% by volume, regions $\mathbf{712}_2$ and $\mathbf{712}_3$ of higher dielectric constant material may be formed as part of forming the insulative portion of the housing for wafer 720. Regions $\mathbf{710}_2$ and $\mathbf{710}_3$ of lower dielectric constant material may be formed by voids in the insulative material used to make the housing for wafer 720. An example of a connector with lower dielectric constant regions formed by voids in an insulative housing is shown in FIG. 2B.

However, regions of lower dielectric constant material may be formed in any suitable way. For example, the regions may be formed by adding or removing material from region $\mathbf{710}_2$ and $\mathbf{710}_3$ to produce regions of desired dielectric constant. For example, region $\mathbf{710}_2$ and $\mathbf{710}_3$ may be molded of material with less or different fillers than the material used to form region $\mathbf{712}_2$ and $\mathbf{712}_3$.

Regardless of the specific method used to form regions of lower dielectric constant, in some embodiments, those regions are positioned generally along the longer edge of the longer conductive element of the pair. In this example, that selective positioning the regions of lower dielectric constant results in positioning between the longer signal conductor and an adjacent ground conductor. For example, region $\mathbf{710}_2$ is positioned between signal conductor $\mathbf{744}_2$B and ground conductor $\mathbf{730}_2$. Likewise, region $\mathbf{710}_3$ is positioned between signal conductor $\mathbf{744}_3$B and ground conductor $\mathbf{730}_3$.

The inventors have appreciated that positioning regions of lower dielectric constant material between the longer signal conductor of a differential pair and an adjacent ground is desirable for reducing skew. While not being bound by any particular theory of operation, the inventors theorize that the common mode components of the signal carried by a differential pair may be heavily influenced by differences in the length of the conductors of the pair caused by curves in the differential pair. In the example of FIG. 7A, common mode components of a signal carried on pair 742$_2$ propagate predominantly in the regions of wafer 720 between signal conductor 744$_2$A and ground 730$_1$ and between signal conductor 744$_2$B and ground conductor 730$_2$. In contrast, the differential mode components of the signal propagate generally in the region between signal conductors 744$_2$A and 744$_2$B.

Figure 7B:
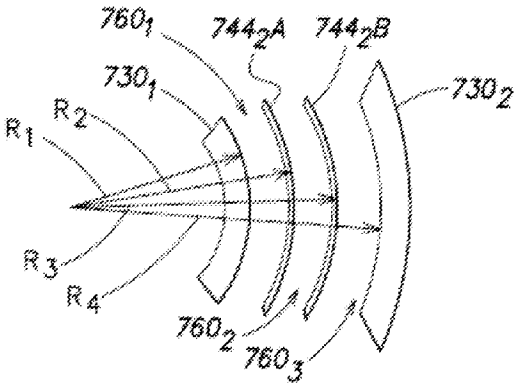
FIG. 7B is a sketch of a curved portion of conductive elements in the wafer of FIG. 7A.

The reasons why common mode components of a signal are most heavily influenced by skew are illustrated in FIG. 7B, which shows a curved portion of differential pair 742$_2$. Common mode components of the signals propagate on differential pair 742$_2$ in regions 760$_1$ and 760$_3$. Differential mode components of the signal propagate in region 760$_2$. The differences in the length of a path through regions 760$_1$ and 760$_3$ that common mode components may travel is greater than the differences in lengths of paths differential mode signals may travel through region 760$_2$.

As can be seen in FIG. 7B, the difference in length of each of the conductive elements in a curved portion depends on the radii of curvature of the conductive elements. In the example illustrated, ground conductor 730$_1$ has an edge with a radius of curvature of $R_1$. Signal conductor 744$_2$A has an radius of curvature of $R_2$. Likewise, signal conductor 744$_2$B and ground conductor 730$_2$ have radii of curvature of $R_3$ and $R_4$, respectfully.

Common mode components propagating in region 760$_3$ must cover a distance that is generally proportional to the radius of curvature $R_4$. The distance that a common mode component travels through region 760$_1$ is proportional to the radius of curvature $R_1$. Therefore, skew in the common mode components will be proportional to the difference $(R_4-R_1)$.

In contrast, the difference in path lengths traveled by the differential mode components traveling through region 760$_2$ is proportional to the difference in the radii of curvature defining the boundaries of region 760$_2$. In the configuration of FIG. 7B, that distance, and therefore differential mode skew, is proportional to $(R_3-R_2)$. As can be seen, $(R_4-R_1)$ is longer than $(R_3-R_2)$, which indicates the common mode skew is potentially larger than the differential mode skew. To reduce skew, particularly common mode skew, it may desirable for common mode components in region 760$_3$ to propagate faster than the common mode components in region 760$_1$. Accordingly, the material forming the housing of wafer 720 in region 760$_3$ may have a lower dielectric constant than the material in region 760$_1$.

As can be seen by comparing FIGS. 7A and 7B, region 760$_3$ (FIG. 7B) overlaps region 710$_2$ (FIG. 7A). Region 760$_1$ (FIG. 7B) overlaps region 712$_2$. Accordingly, positioning material of a lower dielectric constant in regions 710$_2$ and 710$_3$ as shown in FIG. 7A may reduce skew. More generally, material of a lower dielectric constant positioned in region R (FIG. 7A), which extends outward from the center of a differential pair towards a distal edge 732 of an adjacent ground conductor 730$_2$, may reduce skew.

It is not necessary that the entire region R be occupied by material of a lower dielectric constant. In some embodiments, the region of lower dielectric constant material, such as region 710$_2$, does not extend to the distal edge 732 of an adjacent ground conductor. Rather, the region of lower dielectric constant material extends no farther the midpoint of the ground conductor.

A comparison of FIG. 7A and FIG. 7B also illustrates that it is not necessary to alter the dielectric constant of all the material adjacent a signal conductor. Altering the average, or effective, dielectric constant adjacent a signal conductor may be adequate to reduce skew. Thus, even if the entire region R is not completely filled with a lower dielectric constant material, the average dielectric constant may be adequately lowered to de-skew a differential pair.

For example, region 760$_3$ (FIG. 7B) extends above and below the plane containing the conductive elements. However, region 710$_2$ extends generally from a surface 722 of wafer 720 to the plane containing the signal conductors of differential pair 742$_2$. Region 714$_2$ (FIG. 7A) extends below the plane of the signal conductors and contains material of a higher dielectric constant similar to region 712$_2$. Nonetheless, incorporation of region 710$_2$ changes the average or effective dielectric constant of the material adjacent signal conductor 744$_2$B, which is sufficient to alter the speed of propagation of signals through signal conductor 744$_2$B. Thus, extending a region of lower dielectric constant material from surface 722 to approximately a plane containing the signal conductors as shown in FIG. 7A may be sufficient to improve the skew characteristics of differential pair 742$_2$ and is easy to manufacture using an insert molding operation. However, in other embodiments, region 710$_2$ could extend from surface 722 to below the plane containing a differential pair 742$_2$. Such an embodiment could be formed, for example, by inserting material into wafer 720 from both surfaces 722 and 724. Alternatively, differential pair 742$_2$ can be de-skewed even if region 710$_2$ of material of a lower dielectric constant does not extend all the way to the plane containing the signal conductors of pair 742$_2$. Accordingly, the specific size and shape of a region of lower dielectric constant material is not limited to the configurations pictured, and any suitable configuration may be used.

Incorporating regions of lower dielectric constant material may alter other properties of the differential pairs in wafer 720. For example, the impedance of signal conductor 744$_2$B may be increased by a region of lower dielectric constant material 710$_2$. To compensate for an increase of impedance, the width of a signal conductor adjacent a region of lower dielectric constant may be wider than the corresponding signal conductor of the pair. For example, FIG. 7A shows signal conductor 744$_2$B having a width $W_2$ that is greater than width $W_1$ of signal conductor 744$_2$A. Known relationships between the impedance of a signal conductor and the dielectric constant of the material surrounding it may be used to compute a width $W_2$ and $W_1$ to provide signal conductors with similar impedances.

FIG. 7B illustrates a further characteristic of the placement of region of material of lower dielectric constant. As described above, differences in the length of the conductors associated with a differential pair occur where the differential pair curves. To keep the signals propagating through the conductors of a differential pair in unison, it may be desirable to alter the speed of propagation only or predominantly in curved segments of the differential pair.

Figure 8:
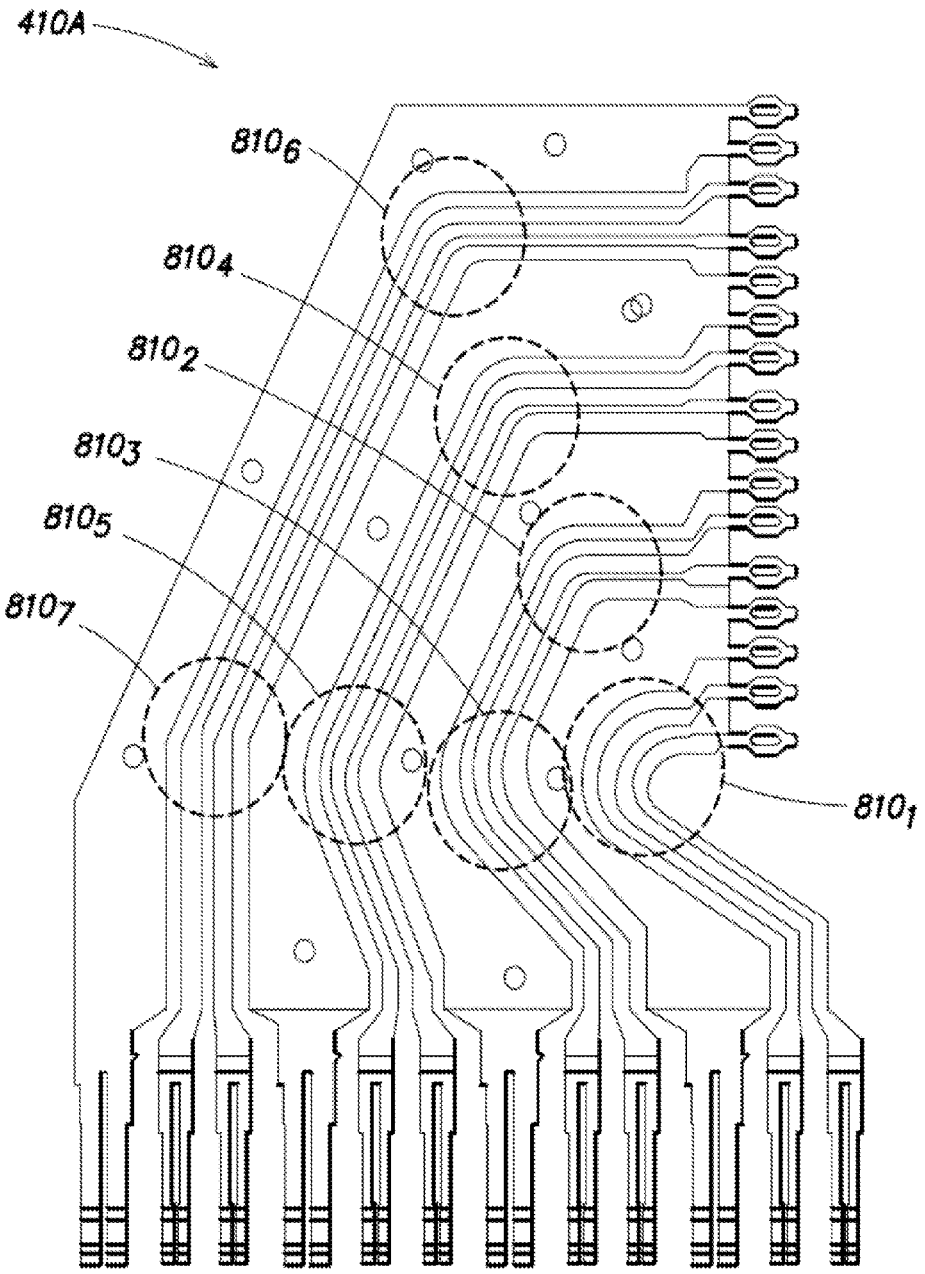
FIG. 8 is a sketch of a wafer strip assembly according to an embodiment of the present invention.

FIG. 8 is a sketch of a wafer strip assembly 410A, showing the entire length of each differential pair within a daughter card wafer. As can be seen in FIG. 8, the differential pairs have curved segments, such as curved segments 810$_1$, 810$_2$, 810$_3$ . . . 810$_7$. In some embodiments, regions of material of relatively lower dielectric constant may be placed adjacent a longer signal conductor of each differential pair only in a curved region 810$_1$, 810$_2$ . . . 810$_7$. The length along the signal conductors of each of the regions of material of relatively lower dielectric constant may be proportionate to the difference in length between the shorter signal conductor of the differential pair and the longer signal conductor of the differential pair traversing that curved region.

Positioning material of relatively lower dielectric constant adjacent curved regions has the benefit of offsetting effects of different length conductors as those effects occur. Consequently, signal components associated with each signal conductor of the pair stay synchronized throughout the entire length of the differential pair. In such an embodiment, the differential pair may have an increased common mode noise immunity, which can reduce crosstalk. Of course, equalizing the total propagation delay through the signal conductors of a differential pair is desirable even if the signal components are not synchronized at all points along the differential pair. Accordingly, the material of relatively lower dielectric constant may be placed in any suitable location or locations.

In the embodiments described above, regions of relatively lower dielectric constant are formed by incorporating into the housing of wafer 720 regions of material that has a lower dielectric constant than other material used to form the housing. However, in some embodiments, a region of relatively lower dielectric constant may be formed by incorporating material of a higher dielectric constant outside of that region.

For example, FIG. 9 shows a wafer 920 having a housing predominantly formed of material 940. Differential pairs $\mathbf{942}_1$ and $\mathbf{942}_2$ are incorporated within the housing of wafer 920. In the example of FIG. 9, signal conductor $\mathbf{944}_1$B is longer than signal conductor $\mathbf{944}_1$A. Likewise, differential pair $\mathbf{942}_2$ has a signal conductor $\mathbf{944}_2$B that is longer than signal conductor $\mathbf{944}_2$A. To reduce the skew of the differential pairs $\mathbf{942}_1$ and $\mathbf{942}_2$, regions $\mathbf{910}_1$ and $\mathbf{910}_2$ may be formed with a lower dielectric constant than material that surrounds the shorter signal conductors $\mathbf{944}_1$A and $\mathbf{944}_2$A.

However, in the embodiment illustrated, regions $\mathbf{910}_1$ and $\mathbf{910}_2$ are formed of the same material used to form the insulative portion of housing 940. Nonetheless, regions $\mathbf{910}_1$ and $\mathbf{910}_2$ have a relatively lower dielectric constant than the material surrounding the shorter signal conductors because of the incorporation of regions $\mathbf{912}_1$ and $\mathbf{912}_2$. In the embodiment illustrated, regions $\mathbf{912}_1$ and $\mathbf{912}_2$ have a higher dielectric constant than the material used to form the insulative portion 940. As described earlier, in some embodiments, regions $\mathbf{912}_1$ and $\mathbf{912}_2$ may be formed adjacent to conductive elements, but not directly in between, as shown in FIG. 9. As depicted, regions $\mathbf{912}_1$ and $\mathbf{912}_2$ may directly contact conductive elements without being formed in between the conductive elements. It can be appreciated that for other embodiments, regions $\mathbf{912}_1$ and $\mathbf{912}_2$ do not necessarily contact adjacent conductive elements. In addition, as shown earlier in FIGS. 2C and 7A, regions $\mathbf{912}_1$ and $\mathbf{912}_2$ may be formed with an opening portion that can be located directly in between conductive elements.

Regions $\mathbf{912}_1$ and $\mathbf{912}_2$ may be formed in any suitable way. For example, they may be formed by incorporating fillers or other material into plastic that is molded as a portion of the housing of wafer 920. However, any suitable method may be used to form regions $\mathbf{912}_1$ and $\mathbf{912}_2$.

FIG. 9 also illustrates some of the variations that are possible in constructing a connector according to embodiments of the invention. In the embodiment of FIG. 9, differential pair $\mathbf{942}_2$ is at the end of a column within wafer 920. Signal conductor $\mathbf{944}_2$B in the pictured embodiment may be too close to the edge of wafer 920 to allow incorporation of a material of lower dielectric constant adjacent signal conductor $\mathbf{944}_2$B. Accordingly, altering the relative dielectric constants through the incorporation of regions $\mathbf{912}_1$ and $\mathbf{912}_2$ of higher dielectric constant may be desirable in an embodiment such as the embodiment of FIG. 9.

The embodiment of FIG. 9 also illustrates that regions of relatively higher and relatively lower dielectric constant material may be formed even when differential pairs are not positioned between ground conductors. For example, differential pair $\mathbf{942}_2$ is adjacent ground conductor $\mathbf{930}_2$ but has no ground conductor on the opposite side of the pair. Thus, while it may be desirable in some embodiments to create regions of relatively higher or relatively lower dielectric constant between a differential pair and a ground conductor, the invention need not be limited in this respect.

FIG. 9 also demonstrates that embodiments may be constructed without incorporating lossy material.

Figure 10:
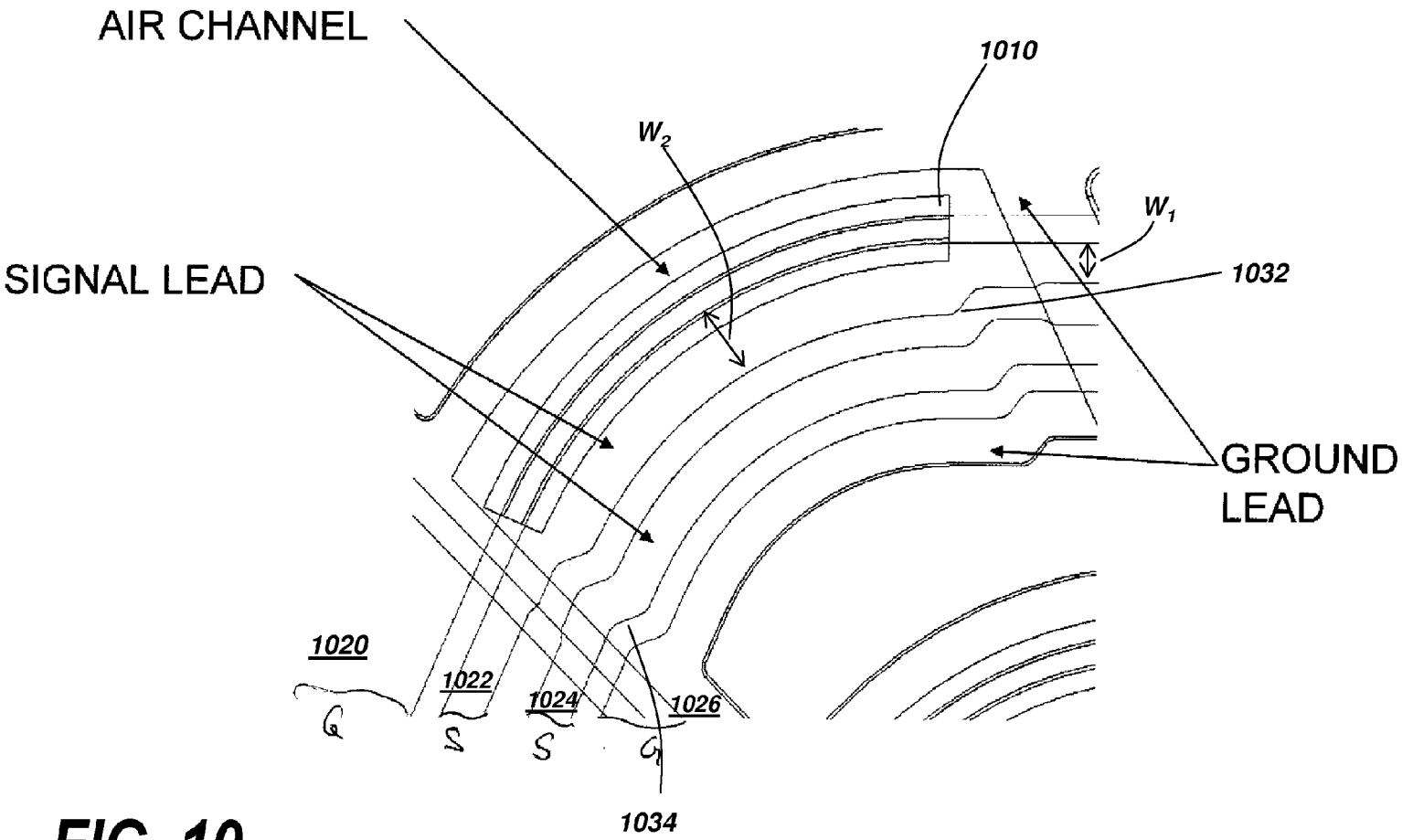
FIG. 10 is a sketch of a lead frame with an impedance-compensated section for skew control.

FIG. 10 illustrates an approach to forming a connector with differential pairs combing skew compensation and impedance compensation, to offset for a change in impedance associated with the skew compensation. FIG. 10 shows a portion of a pair. In this example, the portion is curved, and both skew compensation features and impedance compensation features are incorporated in this portion. It should be appreciated that a pair may have more than one curved portion, some or all of which may include compensation portions as shown in FIG. 10. Moreover, a connector may have multiple pairs in a column of conductive elements. Compensation techniques may be applied with respect to some or all of the pairs. For example, compensation techniques may be applied to the longer pairs, but not the shortest pairs. Further, it should be appreciated that a connector may have multiple columns of conductive elements, such as are formed by multiple wafers, as illustrated in FIG. 1. Compensation techniques may be applied in some or all of the columns. However, for simplicity of illustration, compensation techniques as applied in one portion of one pair in one column are illustrated.

In the example of FIG. 10, skew compensation features are selectively positioned adjacent a longer, outer edge of the longer conductive element of the pair and the impedance compensation features are selectively positioned along the shorter, inner conductive element of the pair. FIG. 10 shows a pair of conductive elements shaped as signal conductors 1022 and 1024. Wider conductive elements, here shaped as ground conductors 1020 and 1026, are shown.

FIG. 10 shows the housing around the conductive elements cut away. However, an opening 1010 in the housing is shown. Opening 1010 crates a region of lower dielectric constant with respect to other regions of the housing. In this example, the material of lower dielectric constant is air such that the conductive elements are exposed in opening 1010. However, it should be appreciated that opening 1010 may be filled with any suitable material, including materials as described above.

As shown, opening 1010 is preferentially positioned along the longer, outer edge of signal conductor 1022. As a specific example, opening 1010 may be approximately centered over a space between an outer edge of signal conductor 1022 and the inner edge of adjacent ground conductor 1020, as illustrated in FIG. 10. In this example, opening 1010 provides an air channel. The channel has an elongated dimension that follows the outer, longer edge of signal conductor 1022.

As described above, such an opening a skew compensation portion because it tends to equalize signal propagation times along the outer signal conductor 1022 and the inner signal conductor 1024. In the example of FIG. 10, signal conductor 1022 is widened to compensate for impedance impacts of the skew compensation portion. However, in this example, the widening is achieved by change in the contour of the inner edge of signal conductor 1022.

In the example illustrated in FIG. 10, signal conductor 1022 has an outer edge that smoothly transitions through a portion of the curve. In the embodiment shown, there are no abrupt jogs or other features along the outer edge. However, the inner edge has an extended portion. The extended portion creates a width $W_2$ in a region of signal conductor 1022 adjacent opening 1010. In contrast, signal conductor 1022 has a nominal width of $W_1$ outside that region. The width $W_2$ may be selected to compensate for impedance changes associated with the skew compensation portions. Because the skew compensation and impedance compensation portions are positioned close together, on opposing edges of the signal conductor in this example, the effects on impedance tend to balance out such that there is minimal impact on impedance from incorporating skew compensation features.

In this example, the change in width is implemented to create jogs in the contour of the inner edge of signal conductor 1022, of which jog 1032 is numbered. Jog 1032 is a jog inwards. A corresponding jog outwards (not numbered), at the opposite end of the widened region is shown. These jogs create, in the widened region, a region of reduced radius of curvature relative to radius of curvature outside the impedance compensation portion.

In the example illustrated, each of the jogs occurs in one or more steps. Such a profile may reduce abrupt changes in electrical properties along the signal conductor, which may improve overall electrical properties of a connector.

Further, in some embodiments, despite the jogs in signal conductor 1022 edge to edge spacing may be maintained between signal conductors of the pair as well as between the signal conductors and adjacent grounds. Accordingly, the inner edge of ground conductor 1020 is shown with a smooth profile, conforming to the smooth profile of the outer edge of signal conductor 1022. However, signal conductor 1024 contains jogged portions, of which jogged portion 1034 is numbered, corresponding to the jogged portions of signal conductor 1022. The jogged portions of signal conductor 1024 are complementary to those of signal conductor 1022 so that signal conductor 1024 jogs around the widened portion of signal conductor 1022.

This jogging of edge profiles may be continued to the adjacent ground conductor 1026. As shown, the outer edge of ground conductor 1026 may jog inward to accommodate the inward jogging of signal conductor 1024 while maintaining a uniform edge-to-edge spacing.

In some embodiments, the inner edge of ground conductor 1026 may be adjacent an outer signal conductor of another pair. In some embodiments, the inner edge of ground conductor 1026 may have a smooth profile similar to that shown for ground conductor 1020. In this way, the structure shown in FIG. 10, for skew compensation and impedance compensation may be repeated for another pair in the next inner row of the connector.

The features may have any suitable dimensions. In some embodiments, the signal conductors may have a nominal width of between about 0.25 and about 0.9 mm. In some embodiments, the width may be between about 0.4 mm and 0.6 mm.

As a further example, and not a limitation of the invention, the difference in width between $W_1$ and $W_2$ may be a percentage of this nominal width, which may be between 10% and 100%, for example, of the nominal width in some embodiments. Though, in other embodiments, the difference may be around 10%, 20%, 30%, 40% or 50%.

The edge-to-edge spacing may be different for signal to ground and signal to signal edges. However, the spacing may be in the range of 0.1 to 0.5 mm, in some embodiments. In other embodiments, the spacing may be in the range of 0.2 to 0.4 mm or between 0.3 and 0.4 mm. The uniformity of this edge spacing may provide a variation of less than +/−20% over the length of the intermediate portions of the conductive elements, in some embodiments. Though, in other embodiments, the uniformity may be less than +/−15% or less than +/−10% or less than +/−5%.

Having thus described several aspects of at least one embodiment of this invention, it is to be appreciated various alterations, modifications, and improvements will readily occur to those skilled in the art.

As one example, it should be understood that openings can be interpreted to be a region of a different dielectric constant, including, for example, but not limited to an air pocket of open space, plastic, or polymer with filler material.

a connector designed to carry differential signals was used to illustrate selective placement of material to achieve a desired level of delay equalization. The same approach may be applied to alter the propagation delay in signal conductors that carry single-ended signals.

Also, columns of conductive elements were illustrated by embodiments in which all conductive elements were positive along a centerline of the column. In some scenarios, it may be described to offset some conductive elements relative to the centerline of the column. Accordingly, a column of conductors may refer generally to and conductors that, in cross section, are arranged in a first direction pattern that has one conductor and multiple conductors along a second, transverse direction.

Further, although many inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

As a further example, connectors with four differential signal pairs in a column were used to illustrate the inventive concepts. However, the connectors with any desired number of signal conductors may be used.

Also, impedance compensation in regions of signal conductors adjacent regions of lower dielectric constant was described to be provided by altering the width of the signal conductors. Other impedance control techniques may be employed. For example, the signal to ground spacing could be altered adjacent regions of lower dielectric constant. Signal to ground spacing could be altered in an suitable way, including incorporating a bend or jag in either the signal or ground conductor or changing the width of the ground conductor.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Such alterations, modifications, and improvements are intended to be part of this disclosure, and are intended to be within the spirit and scope of the invention. Accordingly, the foregoing description and drawings are by way of example only.

The invention claimed is:

1. An electrical connector comprising:

a housing;

a plurality of conductive elements comprising intermediate portions held within the housing, the plurality of conductive elements comprising at least one pair comprising a first conductive element and a second conductive element, the first conductive element being longer than the second conductive element, wherein:

the housing comprises a first region of a first dielectric constant and a second region of a second dielectric constant;

the second dielectric constant is lower than the first dielectric constant;

the second region is preferentially positioned over the first conductive element for a distance along a length of the first conductive element;

the first conductive element comprises a widened portion adjacent the second region; and the second conductive element is jogged adjacent the second region.

2. The electrical connector of claim 1, wherein:

the second region comprises an opening filled with air.

3. The electrical connector of claim 1, wherein:

the plurality of conductive elements further comprises a third conductive element adjacent the second conductive element; and the third conductive element comprises a jogged portion around the widened portion.

4. The electrical connector of claim 3, wherein:

the third conductive element is wider than the first and second conductive elements.

5. The electrical connector of claim 4, wherein:

the first and second conductive elements are configured as a differential pair and the third conductive element is configured as a ground conductor.

6. The electrical connector of claim 5, wherein:

the ground conductor is a first ground conductor; and the plurality of conductive elements further comprises a second ground conductor adjacent the first conductive element.

7. The electrical connector of claim 6, wherein:

the first ground conductor, the second ground conductor and the differential pair are disposed in a plane.

8. The electrical connector of claim 7, wherein:

the plane comprises additional conductive elements of the plurality of conductive elements sized and configured to form a plurality of differential pairs in the plane.

9. The electrical connector of claim 8, wherein:

the housing comprises a housing of a wafer.

10. The electrical connector of claim 9, wherein:

the electrical connector additionally comprises a plurality of like wafers.

11. The electrical connector of claim 10, wherein:

the electrical connector comprises a right-angle connector.

12. The electrical connector of claim 1, wherein:

widened portion is sized to compensate for an impedance discontinuity associated with the second region.

13. The electrical connector of claim 1, wherein:

the plurality of conductive elements further comprises a third conductive element having a uniform edge-to-edge spacing with respect to the first conductive element over the intermediate portions of the first conductive element and the third conductive element.

14. The electrical connector of claim 13, wherein:

an edge of the first conductive element and a facing edge of the third conductive element are free of jogs.

15. The electrical connector of claim 1, wherein:

the first and second conductive elements are configured as a first differential pair, and the electrical connector further comprises:

a third conductive element and a fourth conductive element configured as a second differential pair; and an electrically lossy material portion disposed between the first differential pair and the second differential pair.

16. An electrical connector comprising:

a housing;

a plurality of conductive elements comprising intermediate portions held within the housing, the plurality of conductive elements comprising at least one pair comprising a first conductive element and a second conductive element, the first conductive element being longer than the second conductive element, wherein:

the housing comprises a first region of a first dielectric constant and a second region of a second dielectric constant;

the second dielectric constant is lower than the first dielectric constant;

the second region is positioned with a larger portion over the first conductive element than over the second conductive element;

the first conductive element comprises a widened portion adjacent the second region; and the second conductive element is configured to provide a constant spacing with respect to the first conductive element adjacent the widened portion of the first conductive element.

17. The electrical connector of claim 16, wherein:

the second region comprises an opening filled with air.

18. The electrical connector of claim 16, wherein:

the plurality of conductive elements further comprises a third conductive element adjacent the second conductive element; and the third conductive element comprises a jogged portion around the widened portion.

19. The electrical connector of claim 18, wherein:

the third conductive element is wider than the first and second conductive elements.

20. The electrical connector of claim 19, wherein:

the first and second conductive elements are configured as a differential pair and the third conductive element is configured as a ground conductor.

21. The electrical connector of claim 20, wherein:

the ground conductor is a first ground conductor; and the plurality of conductive elements further comprises a second ground conductor adjacent the first conductive element.

22. The electrical connector of claim 21, wherein:

the first ground conductor, the second ground conductor and the differential pair are disposed in a plane.

23. The electrical connector of claim 22, wherein:

the plane comprises additional conductive elements of the plurality of conductive elements sized and configured to form a plurality of differential pairs in the plane.

24. The electrical connector of claim 23, wherein:

the housing comprises a housing of a wafer.

25. The electrical connector of claim 24, wherein:

the electrical connector additionally comprises a plurality of like wafers.

26. The electrical connector of claim 25, wherein:

the electrical connector comprises a right-angle connector.

27. The electrical connector of claim 26, wherein:

the widened portion is sized to compensate for an impedance discontinuity associated with the second region.

28. The electrical connector of claim 26, wherein:

the second conductive element is jogged adjacent the second region.

29. The electrical connector of claim 16, wherein:

the first and second conductive elements are configured as a first differential pair, and the electrical connector further comprises:

a third conductive element and a fourth conductive element configured as a second differential pair; and an electrically lossy material portion disposed between the first differential pair and the second differential pair.

* * * * *